US010371466B2

(12) United States Patent
Ohkubo et al.

(10) Patent No.: US 10,371,466 B2
(45) Date of Patent: Aug. 6, 2019

(54) METHOD OF PRESERVING HEAT EXCHANGE SURFACE AND METHOD OF COOLING MOIST AIR

(71) Applicant: NATOMICS CO., LTD, Tokyo (JP)

(72) Inventors: Hidetoshi Ohkubo, Tokyo (JP); Mitsuo Seki, Inagi (JP); Sho Matsushita, Tokyo (JP)

(73) Assignee: NATOMICS CO., LTD., Tokyo (JP)

( * ) Notice: Subject to any disclaimer, the term of this patent is extended or adjusted under 35 U.S.C. 154(b) by 0 days.

(21) Appl. No.: 15/029,496

(22) PCT Filed: Oct. 15, 2013

(86) PCT No.: PCT/JP2013/006134
§ 371 (c)(1),
(2) Date: Apr. 14, 2016

(87) PCT Pub. No.: WO2015/056285
PCT Pub. Date: Apr. 23, 2015

(65) Prior Publication Data

US 2016/0273849 A1 Sep. 22, 2016

(51) Int. Cl.
*F25B 47/00* (2006.01)
*F25B 21/04* (2006.01)
(Continued)

(52) U.S. Cl.
CPC ..... *F28F 19/002* (2013.01); *F25B 47/003* (2013.01); *F25B 47/006* (2013.01);
(Continued)

(58) Field of Classification Search
CPC ..... F25B 47/003; F25B 47/006; F25D 21/04; F28F 17/00; F28F 19/002; F28F 19/006
(Continued)

(56) References Cited

U.S. PATENT DOCUMENTS 3,771,323 A * 11/1973 Simons ..... A47F 3/0447 454/193
3,835,660 A * 9/1974 Franck ..... F25D 21/04 312/296
(Continued)

FOREIGN PATENT DOCUMENTS

JP 48-861 U 1/1973
JP 53-20148 A 2/1978
(Continued)

OTHER PUBLICATIONS

International Search Report dated Mar. 4, 2014, issued in counterpart International Application No. PCT/JP2013/006134 (4 pages).

*Primary Examiner* — Henry T Crenshaw
(74) *Attorney, Agent, or Firm* — Westerman, Hattori, Daniels & Adrian, LLP

(57) ABSTRACT

A method of cooling moist air through a heat exchange surface suppresses the formation of dew and frost on a heat exchange surface by preparing a carrier which has a heat conduction ratio higher than that of the moist air if the air temperature in a temperature boundary layer, is below the dew-point when the air temperature in the temperature boundary layer is above 0° C., or below the freezing-point when the air temperature in the temperature boundary layer is below 0° C., the carrier being arranged within the temperature boundary layer and on the heat exchange surface, which is in contact with moist air and is used for cooling; and removing moisture from the air by condensing or sublimating water vapor in the moist air on the surface of the carrier by arranging the carrier opposite of the heat exchange surface and within the temperature boundary layer.

22 Claims, 18 Drawing Sheets

(51) Int. Cl.

| | |
|---|---|
| ***F28F 13/04*** | (2006.01) |
| ***F28F 13/18*** | (2006.01) |
| ***F28F 17/00*** | (2006.01) |
| ***F28F 19/00*** | (2006.01) |
| ***F25D 21/04*** | (2006.01) |

(52) U.S. Cl.
CPC ..... *F25D 21/04* (2013.01); *F28F 13/04* (2013.01); *F28F 13/187* (2013.01); *F28F 17/00* (2013.01); *F28F 19/006* (2013.01)

(58) Field of Classification Search
USPC ..... 165/60, 109.1, 133, 134.1; 62/277, 441
See application file for complete search history.

(56) References Cited

U.S. PATENT DOCUMENTS

| | | | | | |
|---|---|---|---|---|---|
| 4,075,866 | A * | 2/1978 | Williamitis | F25D 17/042 | 261/99 |
| 4,114,065 | A * | 9/1978 | Horvay | F25D 21/04 | 220/592.1 |
| 4,211,090 | A * | 7/1980 | Gelbard | F25D 17/065 | 62/276 |
| 4,328,680 | A * | 5/1982 | Stamp, Jr. | F25D 21/006 | 62/155 |
| 4,643,248 | A * | 2/1987 | Voith | F28G 1/125 | 15/104.061 |
| 4,923,002 | A * | 5/1990 | Haussmann | F28F 1/32 | 165/151 |
| 5,014,774 | A * | 5/1991 | Siak | F25B 39/022 | 165/133 |
| 5,042,575 | A * | 8/1991 | Lindsay | B60H 1/3227 | 165/133 |
| 2004/0060319 | A1* | 4/2004 | Wood | B65D 88/126 | 62/441 |
| 2005/0186871 | A1* | 8/2005 | Hockaday | A61L 2/232 | 442/76 |
| 2006/0124287 | A1* | 6/2006 | Reinders | F24F 5/0035 | 165/166 |
| 2007/0163757 | A1* | 7/2007 | Kiknadze | B21C 37/158 | 165/109.1 |
| 2008/0047686 | A1* | 2/2008 | Reinders | F24F 5/0035 | 165/60 |
| 2009/0277188 | A1* | 11/2009 | Teegen | F25B 39/028 | 62/50.2 |
| 2010/0038061 | A1* | 2/2010 | Olver | F22B 37/107 | 165/134.1 |

FOREIGN PATENT DOCUMENTS

| | | | |
|---|---|---|---|
| JP | 4-39595 | A | 2/1992 |
| JP | 5-306877 | A | 11/1993 |
| JP | 7-294173 | A | 11/1995 |
| JP | 2003-240487 | A | 8/2003 |
| JP | 2007-3110 | A | 1/2007 |
| JP | 2007-268860 | A | 10/2007 |
| JP | 2008-64326 | A | 3/2008 |
| JP | 4224121 | B1 | 2/2009 |
| JP | 2010-25442 | A | 2/2010 |
| JP | 3160488 | U | 7/2010 |
| JP | 2010-286127 | A | 12/2010 |
| JP | 4599592 | B2 | 12/2010 |
| JP | 2012-42193 | A | 3/2012 |
| JP | 2012-82989 | A | 4/2012 |

* cited by examiner $t_w$ = -15℃, $t_a$ = 26℃, $x_a$ = 0.0082kg/kg', Θ = 0°

$\tau = 5\text{min}$ $\tau = 15\text{min}$ $\tau = 30\text{min}$

300μm (a) Wire gauze (b) Cooling surface $t_w = -25℃$, $t_a = 22℃$, $x_a = 0.00911\text{kg/kg'}$, $\Theta = 0°$ $t_w$ = -25℃, $t_a$ = 22℃, $x_a$ = 0.0084kg/kg', $\Theta$ = 0°

METHOD OF PRESERVING HEAT EXCHANGE SURFACE AND METHOD OF COOLING MOIST AIR

TECHNICAL FIELD

The present invention relates to a method of maintaining a heat exchange surface and a method of cooling moist air. More specifically, the present invention relates to a method of maintaining a heat exchange surface which is capable of providing the maintenance-free heat exchange surface by preventing the transfer of mass on a heat exchange surface that has a large temperature differential with the surroundings and a method of cooling moist air which is capable of highly efficiently and stably cooling moist air, in a case where moist air is cooled through the heat exchange surface, or in a case where heat is adsorbed from moist air with temperature below 0° C., within the temperature boundary layer.

BACKGROUND ART

In a case where heat is exchanged between a fluid and a dry air through a heat exchange surface, a dropwise condensation, a frost formation, or a freezing frequently occurs on a side of the heat exchange surface contacting air under the condition that a temperature of the heat exchange surface (referred to as a cooling surface hereinafter) is lower than that of air.

Here, conditions for occurrence of frost formation, or the condensation phenomenon are explained, with reference to FIG. 3. If a condition of water vapor in an atmosphere corresponds to a water-saturated atmosphere (including super-saturated state) under air temperature higher than 0° C., water droplets are generated by water vapor being condensed to condensation nuclei in an atmosphere, and then, falls and accumulates on the cooling surface, whereby water vapor is condensed to such accumulated water droplets by a repetition of the above growth and combining into one process to form into big droplets. When a gravity force exerting on such big droplets exceeds an adhesion force between the big droplets and the cooling surface, the big droplets flows (falls) down on the cooling surface.

If a condition of water vapor in an atmosphere corresponds to the water-saturated atmosphere (including super-saturated state) under air temperature between 0° C. and −40° C., super-cooled water droplets are generated by the water vapor being condensed to condensation nuclei in an atmosphere, and then, fall and accumulate on the cooling surface, whereby the super-cooled water droplets grow to be joined to each other, and then, become frozen, and as a result, the water vapor sublimates to the frozen ice particles to cause the formation of frost.

If a condition of water vapor in an atmosphere corresponds to an ice super-saturated atmosphere and does not correspond to the water-saturated atmosphere under air temperature between 0° C. and −40° C., ice crystals are generated by water vapor being sublimated to sublimation nuclei in the atmosphere, and then, fall and accumulate on the cooling surface, whereby water vapor are sublimated to such accumulated ice crystals to cause the formation of frost.

Now, the condensation or the sublimation phenomenon is explained in more detail. When moist air is cooled, water vapor in the atmosphere becomes super-saturated (referred to as a water super-saturated state) in which the water vapor cannot maintain its gas state any longer, so that the condensation phenomenon sets in. An air temperature at this state is referred to as the dew point. In addition, in a case where an ambient temperature is below 0° C., the water vapor can become either an ice super-saturated state or a water super-saturated state. This is because the amount of super-saturated water vapor under the ice state is smaller than that under the water state, the ice super-saturated phenomenon precedes over the water super-saturated phenomenon, so that the water vapor over the amount of the super-saturated water vapor emerges as ice crystals (referred to as ice crystal hereinafter) by sublimating to the ice crystal nuclei in the atmosphere. An air temperature at the stage is referred to as a freezing point. In this connection, if the water vapor is further cooled under a low temperature to become a water super-saturated condition where a condensation phenomenon sets in, like the case of the air temperature above 0° C., however, under the condition of the air temperature is below −40° C., the condensed droplets immediately become the super-cooled droplets without being frozen. An air temperature at the stage is also referred to as dew point, like a case of the air temperature above 0° C. The super-cooled droplets stochastically become frozen with time. Since the water vapor pressure of the ice is lower than that of the surroundings, water vapor positively sublimates to such an icy surface, whereby frost crystals P4 rapidly start to grow.

In addition, in a case where a condition of water vapor in the atmosphere corresponds to a water-saturated atmosphere (including super-saturated state) under the condition that the air temperature is below −40° C., the water vapor is caused to condense to the condensation nuclei in the atmosphere to immediately form into frozen particles, and then, frozen particles having fallen and accumulated on the cooling surface to form frost in a powder form. In this connection, if the temperature of the cooling surface is below −40° C., but the air temperature in the atmosphere is above −40° C. warmer than the cooling surface, the accumulated powder frost gets thick, and if the temperature of the surface of the frost layer becomes above −40° C. due to that it is exposed to the atmosphere, water vapor sublimates to the frost to cause the formation and the growth of the frost.

Further, in a case where a condition of water vapor in the atmosphere corresponds to an ice super-saturated atmosphere and does not correspond to the water-saturated atmosphere under the condition that the air temperature is below −40° C., the water vapor is caused to sublimate to sublimation nuclei in the atmosphere to immediately form into ice crystals, and then, the water vapor sublimates to ice crystals having fallen and accumulated on the cooling surface to form frost.

In this connection, the above explanation is based on the assumption that the condensation nuclei or the sublimation nuclei exist in the atmosphere within the temperature boundary layer near the cooling surface. However, since the condensation nuclei or the sublimation nuclei also exist on the cooling surface, the condensation or the sublimation phenomenon can directly occur on the cooling surface. This follows that, even if the super-saturated phenomenon does not occur in the air, the condensation or the sublimation phenomenon can occur on the cooling surface, only if the condition of the cooling surface corresponds to the surroundings.

The dew is a cause of a deterioration of a hygienic aspect such as generation of fungus, corrosion, electrical leak, or a smear of the heat exchange surface S, while the formation of the frost or the freezing is a cause for a decrease of the amount of heat exchange along with a thermal resistant layer caused by a liquid membrane on the heat exchange surface S upon the generation of dew, since a frost layer or an ice layer forms another thermal resistant layer upon the heat exchange and its physical thickness hinders an air-passage. Needless to say, if the frost or the ice melts, the problem is the same as in the case of the dropwise condensation generating dew occurs. Such being the case, conventionally, various kinds of technologies for defrosting or dehumidifying the heat exchange surface S has been adopted.

In this connection, a patent publication 1 discloses an agent for adjusting a humidity using multi-cellular material, or an agent for preventing dew.

More specifically, the agent for adjusting a humidity using multi-cellular material, or the agent for preventing dew, are constituted by agglomerating fine particles at a nano level without a gap between the particles being lost each of which particle does not include multi-cellular characteristics. In other words, multi-cellular material including an empty hole at a nano level between fine particles is adopted, so that a multi-cellular structure including a distribution of fine holes in which a diameter of fine hole ranges between 1 nm and 10 nm. Based on a capillary condensation theory by Kevin, the amount of adsorbing water vapor increases at the range of relative humidity of between 75% and 93%. More concretely, an isothermic adsorbing curve rises near about 80%, and the amount of adsorbing water vapor between relative humidity of 75% and 93% is about 12 mass %, so that water vapor adsorbed between the relative humidity of 75% and 93% is emitted at the relative humidity 70%, whereby an ability for preventing dew is recovered, under the isothermic adsorbing curve.

By such an agent for adjusting a humidity using multi-cellular material, or an agent for preventing dew, water vapor in moist air which causes dew is adsorbed, while at the same time, the ability for preventing dew can be recovered by adsorbed water vapor being emitted, so that the agent can be repeatedly used. In addition, water vapor in the moist air can be caught due to the diameter of the fine hole being between 1 nm and 10 nm. However, in a case where super-cooled condensed droplets are generated in the moist air under the condition that the temperature of moist air is below 0° C., humidity cannot be adjusted, or the generation of dew cannot be prevented by catching super-cooled condensed droplets, since the diameter of super-cooled condensed droplets is at least 1 μm.

In this respect, it has been desired to realize a method of maintaining the maintenance-free heat exchange surface by preventing mass transfer on the heat exchange surface whose temperature largely differs from the surroundings, in case of a device for cooling moist air for a refrigerator processing moist air with temperature of below 0° C.

On the other hand, in a case where moist air is cooled to below 0° C. by a device for cooling moist air, in particular, or in a case where heat is adsorbed from the moist air by a LNG vaporizer, not dew, but frost formation or freezing can occur on the cooling surface which constitutes the heat exchange surface.

In such a case, a frost layer becomes a thermal resistant layer, because of its low thermal conductivity, or grown frost can block a passage of the moist air which is a target to be cooled, so that an efficiency of exchanging heat can decrease, on the whole.

In this respect, a patent publication 2 discloses a heat exchanger which can utilize a solidification heat, while at the same time, can continuously operate for a long time by making it easy to mechanically remove frost.

More specifically, this heat exchanger is the one which can adsorb heat from the moist air and includes fine concave and convex portions on its surface. On an upper surface of the convex portion, a flat portion with a minimum width being between 100 μm and 500 μm is formed, and a minimum width of the concave portion is between 100 μm and 1000 μm. Frost crystals P4 can vertically grow on the flat portion of the upper surface of the convex portion, by providing the convex and concave portions on the surface of the heat exchanger. Since the frost crystals P4 grow on the convex portions, while a gap is formed around the concave portions, the frost crystals P4 in a comb-teeth form are formed. Such a comb-teeth form is structurally weak, the frost crystals P4 can be readily removed by a mechanical device such as a brush, a scraper, etc. This allow for the heat exchanger to be continuously operated for a long time, while at the same time to utilize the solidification heat.

Further, a patent publication 3 discloses a member for preventing a frost formation. More specifically, in this member, a water repellant portion and a hydrophilic portion whose hydrophilic property is higher than the water repellant portion are formed in a predetermined pattern.

A frost is difficult to form on the water repellant portion due to its high water repellant property, while a frost is easy to form on the hydrophilic portion. Accordingly, a frost on the hydrophilic portion grows until its size becomes the one which cannot resist on an air flow, and then, it collapses, since a frost cannot grow on the water repellant portion, while a frost can largely grow on the hydrophilic portion. Such a growth and a collapse of frost is repeated.

As described above, a frost formation can be suppressed by promoting a repetition of the growth and the collapse of frost by means of the formation of the water repellant portion and the hydrophilic portion in a predetermined pattern.

However, in a case where a frost formation is prevented by the process or the treatment of the heat exchange surface, as disclosed by the patent publications 2 and 3, a frost formation can inevitably occur with time, so that a state in which a frost is not formed cannot be maintained for a long time.

On the other hand, since the situation in which frost is formed can vary, in accordance with the conditions on the temperature and the humidity of the coolant or the moist air, or the variation of the state in which the moist air flows, it is difficult to meet the variation of such conditions.

Further, although it is possible to accelerate a sensible heat exchange, since frost formation of the moist air on the cooling surface can be prevented, a latent heat exchange (solidification heat) involved by change of phase of water vapor is excluded, so that the method of exchanging heat in total is not necessarily improved.

In this connection, a patent publication 4 discloses a device for reducing frost formation on a cooler. More specifically, this device is disposed near the heat exchanger for cooling including a heat transfer tube and a plurality of fins each of which is attached on the heat transfer tube, and includes a jetting means including a plurality of nozzles disposed perpendicular, or parallel to the direction in which planes of the fins extend, and a driving means for driving the jetting means in a reciprocal manner. The jetting means moves parallel or perpendicular to the direction in which planes of the fins extend to jet the moist air. The plurality of nozzles arranged in one row and move parallel or perpendicular to the direction in which planes of the fins extend to jet the moist air. The moist air is jetted to the entire area of the fins of the heat exchanger for cooling by discharging the moist air along the surface of the fins of the cooler, so that water droplets in a super-cooled state before they are formed into frosts and the frozen frost can be removed by exerting a fluid pressure on the frost formed on the surface of the fin, since frost formation can be reduced by a small amount of the moist air without halting the operation of the cooling device, the efficiency of the cooling operation can be maintained at a high level, and the cost for preventing frost formation and removing the frost can be reduced.

However, the device for reducing frost formation for the cooler forcibly removes the frost by jetting moist air to the frost formed on the surface of the fin, so that it neither prevents frost formation, nor utilizes the frost formed on the surface of the fin. In addition, maintenance has to be carried out in such a way that the formed frost does not block an opening of the nozzle, since the device for reducing frost formation is disposed near the heat exchanger for cooling.

In this respect, patent publications 5 and 6 disclose a net for removing iced frost or iced snow which removes snow from a wind-shield of an automobile, in a case where ice or frost is adhered to the wind-shield of the automobile, or in a case where snow is accumulated thereon.

More specifically, this net for removing iced frost or iced snow is constituted by wires with a predetermined width arranged in a planar mesh with a predetermined width and is directly laid on the wind-shield of the automobile.

By such a net for removing iced frost or iced snow, ice, frost, or snow accumulated on the wind-shield through opening portion of the mesh can be removed by pulling or removing the net which has become in one piece with the ice, or the frost formed in the opening portions of the mesh, or the snow accumulated in the opening portions of the mesh.

Such being the case, since the ice, frost, or snow to be removed and the net become in one piece, the width of the wire is determined in accordance with the thickness of the formed ice, frost, or snow, while the width of the mesh is determined in accordance with the adhesion force of the wires to the formed ice, frost, or snow.

In more detail, if the thickness of the ice, frost, or the snow is about 3 millimeter, the width of the wire is set to be between 2 millimeter and 6 millimeter, while the width of the mesh is set to be between 10 millimeter and 50 millimeter (patent publication 5). If the thickness of the ice, frost, or the snow is below 2 millimeter, the width of the wire is set to be between 0.5 millimeter and 2 millimeter, while the width of the mesh is set to be between 1 millimeter and 10 millimeter (patent publication 6).

In either of the above cases, the net for removing iced frost or iced snow merely removes iced frost or iced snow by pulling or removing the net which has been simply formed and has become in one piece with the iced frost or iced snow formed on the wind-shield of the automobile, like a case where the frost is not formed on the wind-shield of the automobile which is under a roof of a parking facility.

As described above, in the conventional heat exchange surface, the heat exchange surface cannot be maintained for a long time, and maintenance of the heat exchange operation on the cooling surface becomes difficult with time.

In short, a technical idea in which the condensation or frost formation phenomenon is caused separately from the cooling surface is neither suggested nor disclosed in the conventional heat exchange surface.

Patent Publication 1: Japanese Patent Publication No. 4599592

Patent Publication 2: Japanese Patent Laid-open Publication 2012-82989

Patent Publication 3: Japanese Patent Laid-open Publication 2003-240487

Patent Publication 4: Japanese Patent Laid-open Publication 2008-64326

Patent Publication 5: Japanese Utility Model Publication No. 3160488

Patent Publication 6: Japanese Patent Publication No. 4224121

DISCLOSURE OF THE INVENTION

Problems to be Solved by the Invention

In view of the technical problem described above, it is an object of the present invention to provide a method of maintaining a heat exchange surface which is capable of making the heat exchange surface maintenance-free by preventing mass transfer on the heat exchange surface, the temperature of which largely differs from its surroundings.

It is another object of the present invention to provide a method of cooling moist air which is capable of highly efficiently and stably cooling moist air on the heat exchange surface, in a case where moist air is cooled through the heat exchange surface, or heat is absorbed from the moist air with the temperature below a freezing point within a temperature boundary layer.

In the present invention, after attention is paid to the condensation, the frost formation, or the freezing phenomena occurring on the heat exchange surface, an innovative idea in which condensation, frost formation, or freezing phenomena are caused to occur separately from the cooling surface is devised.

In order to attain the above object, a method of maintaining the heat exchange surface according to the present invention is configured as follows.

A method of maintaining a heat exchange surface is characterized by suppressing the formation of dew and frost on a heat exchange surface which is in contact with moist air and is used for cooling, within a temperature boundary layer which is determined in accordance with the temperature and airflow on the heat exchange surface by involving a step for removing moisture from the air by condensing or sublimating water vapor in the moist air, if the air temperature in the temperature boundary layer is below the dew-point under the condition the air temperature in the temperature boundary layer is above 0° C., or below the freezing-point under the condition the air temperature in the temperature boundary layer is below 0° C.

According to the above configuration, in the heat exchange surface for cooling moist air contacting the heat exchange surface, within a temperature boundary layer determined in accordance with the temperature of the heat exchange surface and the air flow thereon, in a case where the temperature is below the dew point under the condition that the temperature of air in the temperature boundary layer is above 0° C., or in a case where the temperature is below the freezing point under the condition that the temperature of air in the temperature boundary layer is below 0° C., moist air is dehumidified before it reaches the heat exchange surface by condensing water vapor in the moist air to the condensation nuclei or by sublimating it to the ice crystal nuclei, whereby the amount of water vapor in the moist air reaching the heat exchange surface is decreased, and as a result, mass transfer on the heat exchange surface the temperature of which largely differs from the surroundings is suppressed by suppressing the generation of dew or frost formation on the heat exchange surface, so that the heat exchange surface on a maintenance-free basis can be obtained by reducing a trouble for removing droplets due to the dropwise condensation generating dew or the frost due to frost formation.

In this connection, the technical meaning of the freezing point is to be defined in this specification as follows. When moist air is cooled, water vapor in the atmosphere becomes super-saturated (referred to as a water super-saturated state) in which the water vapor cannot maintain its gas state any longer, so that the condensation phenomenon sets in. An air temperature at this state is referred to as the dew point. In addition, in a case where an ambient temperature is below 0° C., the water vapor can become either an ice super-saturated state or a water super-saturated state. This is because the amount of super-saturated water vapor under the ice state is smaller than that under the water state, the ice super-saturated phenomenon precedes over the water super-saturated phenomenon, so that the water vapor over the amount of the super-saturated water vapor emerges as ice crystals (referred to as ice crystal hereinafter) by sublimating to the ice crystal nuclei in the atmosphere. An air temperature at the stage is referred to as a freezing point. In this connection, if the water vapor is further cooled under a low temperature to become a water super-saturated condition where a condensation phenomenon sets in like the case of the air temperature above 0° C., however, under the condition in which the air temperature is below −40° C., the condensed droplets immediately become the super-cooled droplets without being frozen. An air temperature at the stage is also referred to as dew point, like a case of the air temperature above 0° C.

It is preferred to further include a step of providing a carrier including the heat conduction ratio higher than that of moist air to dispose the carrier opposed to the heat exchange surface and within the temperature boundary layer to condense water vapor in the moist air, or to cause water vapor to form into frost, on the surface of the carrier.

In addition, it is preferred to further include a step of replacing the carrier when the dehumidifying performance of the carrier is deteriorated.

In order to attain the above object, a method of cooling moist air through a heat exchange surface according to the present invention is configured as follows.

This method of cooling moist air through the heat exchange surface is characterized by suppressing the formation of dew and frost on a heat exchange surface by involving: a step for preparing a carrier which has a heat conduction ratio higher than that of the moist air if the air temperature in a temperature boundary layer, which temperature boundary layer is determined in accordance with the temperature and airflow on the heat exchange surface, is below the dew-point under the condition the air temperature in the temperature boundary layer is above 0° C., or below the freezing-point under the condition the air temperature in the temperature boundary layer is below 0° C., said carrier being arranged within the temperature boundary layer and on the heat exchange surface, which is in contact with moist air and is used for cooling, and a step for removing moisture from the air by condensing or sublimating water vapor in the moist air on the surface of the carrier by arranging the carrier opposite of the heat exchange surface and within temperature boundary layer.

According to the above configuration, in the heat exchange surface for cooling moist air contacting the heat exchange surface, within a temperature boundary layer determined in accordance with the temperature of the heat exchange surface and the air flow thereon, in a case where the temperature is below the dew point under the condition that the temperature of air in the temperature boundary layer is above 0° C., or in a case where the temperature is below the freezing point under the condition that the temperature of air in the temperature boundary layer is below 0° C., when the moist air is cooled to below 0° C. through the heat exchange surface, or when heat is absorbed form the moist air the temperature of which is below 0° C., a carrier including the heat conduction ratio higher than that of moist air is provided to be disposed opposed to the heat exchange surface and within the temperature boundary layer, so that moist air is dehumidified by condensing water vapor in the moist air, or by causing it to form into frost, on the surface of the carrier, whereby the amount of water vapor in the moist air reaching the heat exchange surface is reduced, and as a result, highly efficient and stable cooling on the heat exchange surface can be effected without the frost growing into a thermal resistant layer by suppressing the dropwise condensation generating dew or frost formation on the heat exchange surface.

In addition, it is preferred to further include a step of condensing water vapor in the moist air on the surface of the carrier opposed to the heat exchange surface whose temperature is below the dew point of the moist air to flow the condensed liquid down along the surface of the carrier, under the condition that the temperature of the moist air within the temperature boundary layer determined in accordance with the temperature of the heat exchange surface and the air flow thereon is above 0° C.

Further, it is preferred to further include a step of sublimating water vapor in the moist air into a surface of ice which has gone through condensation, super-cooling, and loss of super-cooling, on the surface of the carrier opposed to the heat exchange surface whose temperature is below the dew point of the moist air to cause it to grow into frost crystals P4, whereby the moist air is dehumidified to suppress frost formation on the heat exchange surface, under the condition that the temperature of the moist air within the temperature boundary layer determined in accordance with the temperature of the heat exchange surface and the air flow thereon is between 0° C. and −40° C.

Still further, it is preferred to further include a step of growing the water vapors in the moist air into ice crystals formed by condensing and solidifying (freezing), on the surface of the carrier opposed to the heat exchange surface whose temperature is below the dew point of the moist air to cause it to grow into ice crystals, whereby the moist air is dehumidified to suppress frost formation on the heat exchange surface, under the condition that the temperature of the moist air within the temperature boundary layer determined in accordance with the temperature of the heat exchange surface and the air flow thereon is below −40° C.

More still further, it is preferred to further include a step of sublimating water vapor in the moist air, on the surface of the carrier opposed to the heat exchange surface whose temperature is above the dew point of the moist air and below the freezing point to grow it into frost crystals P4, whereby the moist air is dehumidified to suppress frost formation on the heat exchange surface, under the condition that the temperature of the moist air within the temperature boundary layer determined in accordance with the temperature of the heat exchange surface and the air flow thereon is below 0° C.

It is preferred that the carrier is shaped to be a planar structure with a regular or irregular cross section in which non-opening portions each of which including a predetermined width and openings are arranged in an alternate manner and is disposed away from the heat exchange surface with a predetermined distance.

Further, it is preferred that the planar carrier is shaped to be a mesh-form including openings with a predetermined widths and wires with predetermined widths and thicknesses.

Still further, it is preferred that the width of the planar carrier is between 100 μm and 2000 μm, the width of the opening is between 100 μm and 1000 μm, and the distance between the surface of the carrier at the side of the temperature boundary layer and the heat exchange surface is above 100 μm.

Still further, it is preferred that the carrier is shaped to be a three-dimensional structure with voids constituted by fibers with predetermined lengths and a regular or irregular cross section being superimposed in a non-woven manner.

Still further, it is preferred that the planar carriers are disposed along the heat exchange surface to be separated from each other so as to define a gap of an opening between adjacent carriers and that a portion of the carriers upstream of the heat exchange surface is disposed in a main air flow outside the temperature boundary layer, whereby heat transfer through the heat exchange surface is promoted by guiding the air flow inside the carriers within the temperature boundary layer.

Still further, it is preferred that the three-dimensional carriers are thickened in such a way that a portion of the carrier is disposed in the main air flow outside the temperature boundary layer, whereby heat transfer through the heat exchange surface is promoted by guiding the air flow inside the carrier within the temperature boundary layer.

Still further, it is preferred that water repellent treatment is carried out on the surface of the carrier to vary the surface condition of the carrier so as to improve the dehumidification performance by the sublimation, or the condensation of the water vapor on the surface of the carrier and so as not to block the openings by the formed liquid.

Still further, it is preferred that the surface of the carrier is set to possess an adsorption performance to vary the surface condition of the carrier so as to improve the dehumidification performance by the sublimation, or the condensation of the water vapor on the surface of the carrier.

Still further, it is preferred that the fibers of the carrier is made of high water absorptivity resin to enhance the water absorptivity, water retentivity, and capillary water absorptivity of the carrier to improve the dehumidification performance by the sublimation, or the condensation of the water vapor on the surface of the carrier.

Still further, it is preferred that the method of cooling moist air through a heat exchange surface according to the present invention includes a step of taking out the carrier with the frost formed thereon at the side of the temperature boundary layer to utilize the frost so as to use the amount of heat of the frost.

Still further, it is preferred that the method of cooling moist air through a heat exchange surface whose temperature is below 0° C. according to the present invention includes a step of providing the carrier made of material the heat conduction ratio of which is low and disposing the carrier near and within the temperature boundary layer and setting the temperature of the surface of the carrier as high as possible to suppress the amount of the frost growing on the surface of the carrier, whereby a sensible heat exchange through the heat exchange surface as well as a latent heat exchange through the surface of the carrier is carried out.

According to the above configuration, in the heat exchange surface for cooling moist air contacting the heat exchange surface whose temperature is below 0° C., within the temperature boundary layer determined in accordance with the temperature of the heat exchange surface and the air flow thereon, in a case where the temperature of air in the temperature boundary layer is below the freezing point, when the carrier including the heat conduction ratio higher than that of moist air is provided to be disposed opposed to the heat exchange surface and within the temperature boundary layer, moist air is dehumidified by condensing or sublimating water vapor in the moist air on the surface of the carrier, whereby the amount of water vapor in the moist air reaching the heat exchange surface is reduced, and as a result, highly efficient and stable cooling on the heat exchange surface can be effected without the frost growing into a thermal resistant layer by suppressing the dropwise condensation generating dew or frost formation on the heat exchange surface, while at the same time, the time period for the frost being saturated on the surface of the carrier is lengthened to delay the deterioration of air-passage characteristics of the moist air, whereby the continuous latent heat exchange through the surface of the carrier is accomplished by providing the carrier made of material the heat conduction ratio of which is low and disposing the carrier near and within the temperature boundary layer and setting the temperature of the surface of the carrier as high as possible to suppress the amount of the frost growing on the surface of the carrier.

Still further, it is preferred that the method of cooling moist air through a heat exchange surface whose temperature is below 0° C. according to the present invention includes a step of providing the carrier made of material the heat conduction ratio of which is high and disposing the carrier near and within the temperature boundary layer and setting the temperature of the surface of the carrier as low as possible to increase the amount of the frost growing on the surface of the carrier, whereby the sensible heat exchange through the heat exchange surface as well as the latent heat exchange through the surface of the carrier is promoted.

According to the above configuration, in the heat exchange surface for cooling moist air contacting the heat exchange surface whose temperature is below 0° C., within a temperature boundary layer determined in accordance with the temperature of the heat exchange surface and the air flow thereon, in a case where the temperature of air in the temperature boundary layer is below the freezing point, when the carrier including the heat conduction ratio higher than that of moist air is provided to be disposed opposed to the heat exchange surface and within the temperature boundary layer, moist air is dehumidified by condensing or sublimating water vapor in the moist air on the surface of the carrier, whereby the amount of water vapor in the moist air reaching the heat exchange surface is reduced, and as a result, highly efficient and stable cooling on the heat exchange surface can be effected without the frost growing into a thermal resistant layer by suppressing the dropwise condensation generating dew or frost formation on the heat exchange surface, while at the same time, the latent heat exchange through the surface of the carrier is promoted by providing the carrier made of material the heat conduction ratio of which is high and disposing the carrier near and within the temperature boundary layer and setting the temperature of the surface of the carrier as low as possible to increase the amount of the frost growing on the surface of the carrier.

BEST MODE FOR CARRYING OUT THE INVENTION

A first embodiment of the present invention is described in detail, with reference to the drawings.

In the following embodiments, a size, a material, a specific numerical limitation, etc. are only examples for making it easy to grasp the present invention, so that these elements are not intended to limit the present invention, unless explicitly described otherwise, in particular.

In the following description, with respect to the same elements as those in the following embodiments, an explanation thereabout is omitted by attaching the same reference numbers to those elements.

With an example of a case where an air is cooled to below 0° C. by using coolant by means of a heat exchanger HX, the embodiment of the present invention is explained about, with reference to the drawings.

Figure 1:
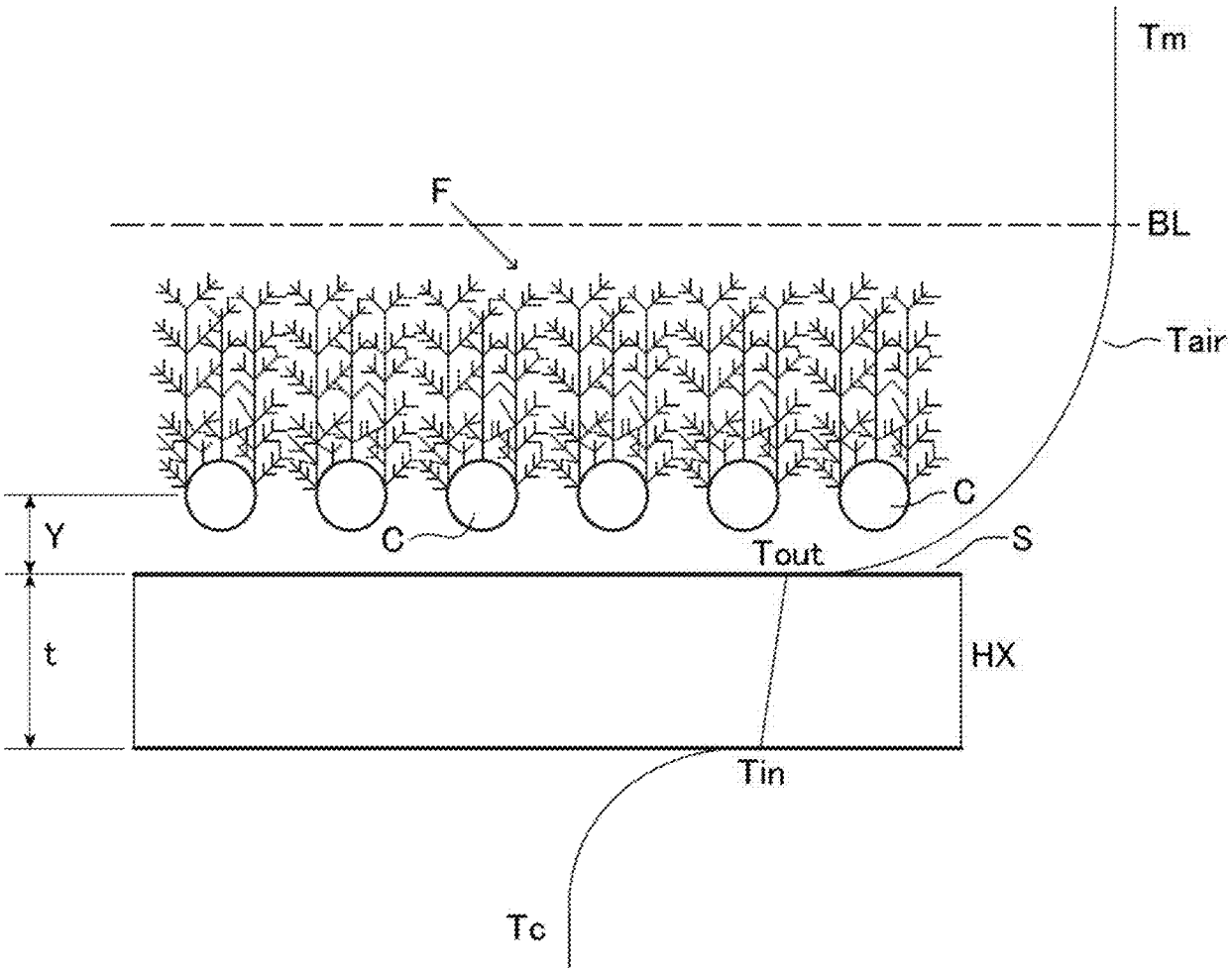
FIG. 1 is a general side view illustrating a first embodiment of the present invention.

As shown in FIG. 1, a planar carrier with openings is disposed in an atmosphere of a moist air outside of the heat exchanger HX.

The heat exchanger HX includes the thickness t and an outer surface of the heat exchanger HX forms a heat exchange surface S by flowing coolant with temperature of Tc inside of the heat exchanger HX.

Tin of the moist air flowing along the cooling surface constitutes a temperature distribution in which a slow slope is formed within a temperature boundary layer BL formed based on the surface of the heat exchange surface S to a low Tout of the cooling surface. The following explanation is under the condition that the temperature of the air is between 0° C. and −40° C.

At this stage, in a case where the planar carrier C including openings in the temperature boundary layer BL is formed so as to secure a gap relative to the heat exchange surface S, water vapor in the moist air becomes a saturated state (the temperature of air becomes the dew point) at the opposite side of the heat exchange surface S in the carrier C, due to the lowering of its temperature, so that the condensation occurs in the condensation nuclei in the air.

Such floating condensed droplets P1 fall down and accumulate to form a group of droplets on the surface of the carrier C.

The group of droplets grows by a coalescence of the droplets P1 newly falling down and accumulating, or by water vapor being condensed in the atmosphere.

The droplets are super-cooled in many cases, but when they grow up to 100 μm, a super-cooled state is lost, so that a frozen ice surface is formed. At this stage, water vapor begins to sublimate to the frozen ice surface, so that frost crystals P4 are rapidly formed. Since the openings O are closed by the formation of the frost, the frost with air-passage characteristics grow thick. At this stage, the water vapor in the moist air grows into the frost crystals P4, so that the amount of the water vapor reaching the heat exchange surface S through the carrier C decreases due to the water vapor being caught by the frost crystals P4, whereby the growth of the frost on the heat exchange surface S is halted.

In this state, a sensible heat exchange is stably conducted through the heat exchange surface S by the formation of the frost on the surface of the carrier C disposed within the temperature boundary layer BL.

Although the amount of heat transfer is gradually decreased due to an increase of a thermal resistance of the frost layer, in a case where the frost crystals P4 grow on the heat exchange surface S, a stable heat exchange transfer is attained by such gradual decrease of the amount of the heat transfer being halted. In addition, since a latent heat transfer through the carrier C is conducted due to the fact that the formation of the frost occurs in the same manner as a case of that through the conventional heat exchange surface S, the total amount of heat exchange increases more than that under the growth of the frost only on the heat exchange surface S.

Such being the case, a new heat exchange configuration in which the latent heat exchange through the surface of the carrier C and the conventional sensible heat exchange through the heat exchange surface S are separated from each other is attained by an innovative idea in which the carrier C including the openings S is formed within the temperature boundary layer BL of the heat exchange surface S.

Figure 2:
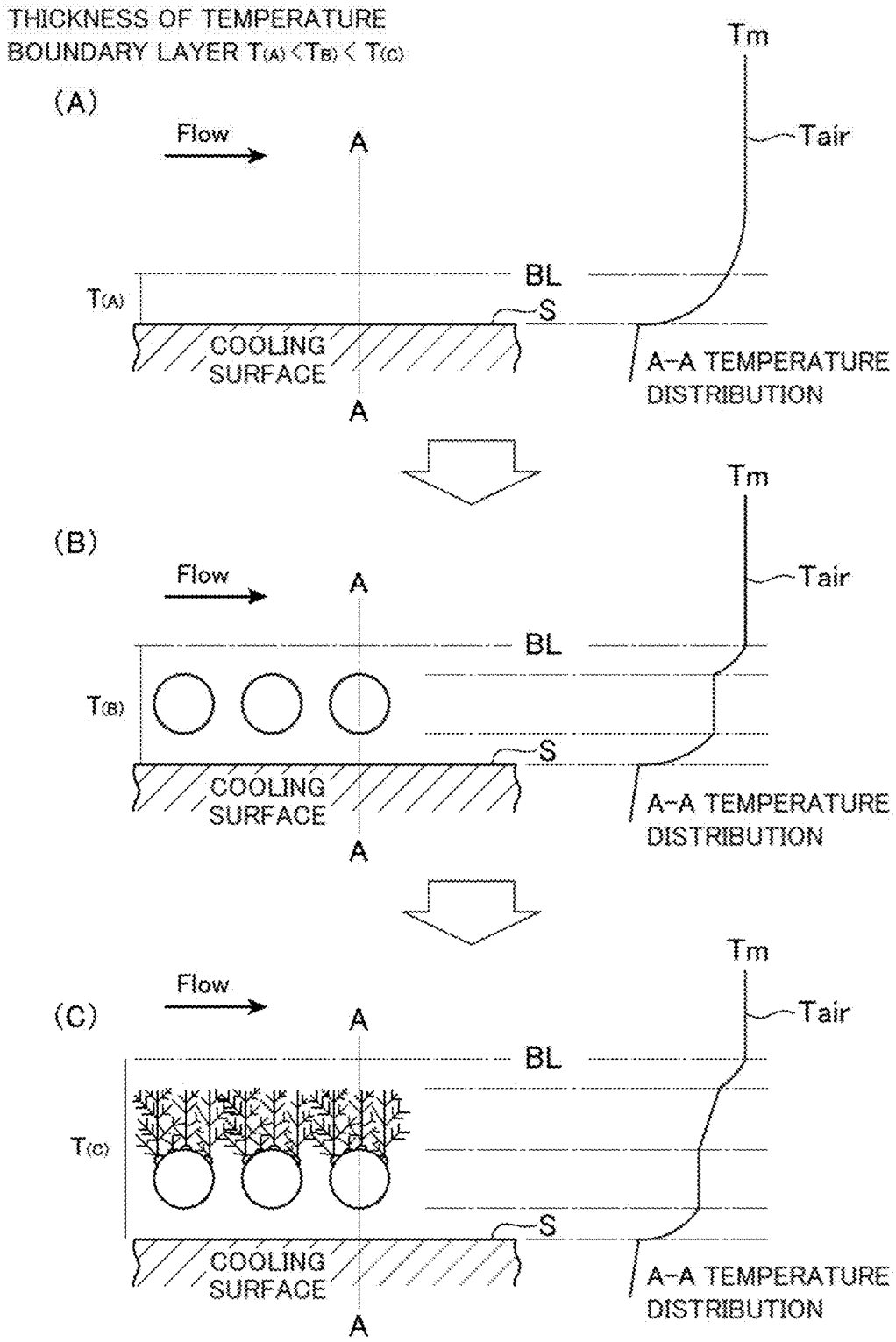
FIG. 2 is a schematic view illustrating a temperature distribution in accordance with the situation in which the frost is formed on the carrier C, in the first embodiment of the present invention.

In this connection, with respect to the temperature boundary layer BL described above, the thickness of the temperature boundary layer BL varies in accordance with environmental conditions. Normally, the environmental conditions include the ambient temperature and the flow of fluid, however, an explanation about such conditions are omitted here. What is explained about here is a case how the frost layer grows on the surface of the carrier C within a temperature boundary layer BL in FIG. 1 within which nothing exists as shown in FIG. 2(A). As shown in FIG. 2(B), the thin temperature boundary layer BL in FIG. 2(A) becomes thick by the carrier C being disposed therewithin. In addition, as shown in FIG. 2(C), the more the frost grows, the thicker the temperature boundary layer BL becomes. Such being the case, although the frost may grow within a constant temperature boundary layer BL within which nothing exists by the carrier C being disposed therewithin, even if the thickness of the temperature boundary layer BL is very thin, the temperature boundary layer BL becomes thick under the condition that the heat conduction ratio of the carrier C is higher than that of air. This follows that it is considered to be feasible to vary and thicken the thickness of the temperature boundary layer BL by disposing at least a portion of the carrier C within the temperature boundary layer BL, so that there is considered to be much room for utilizing the above-described phenomenon.

Figure 3:
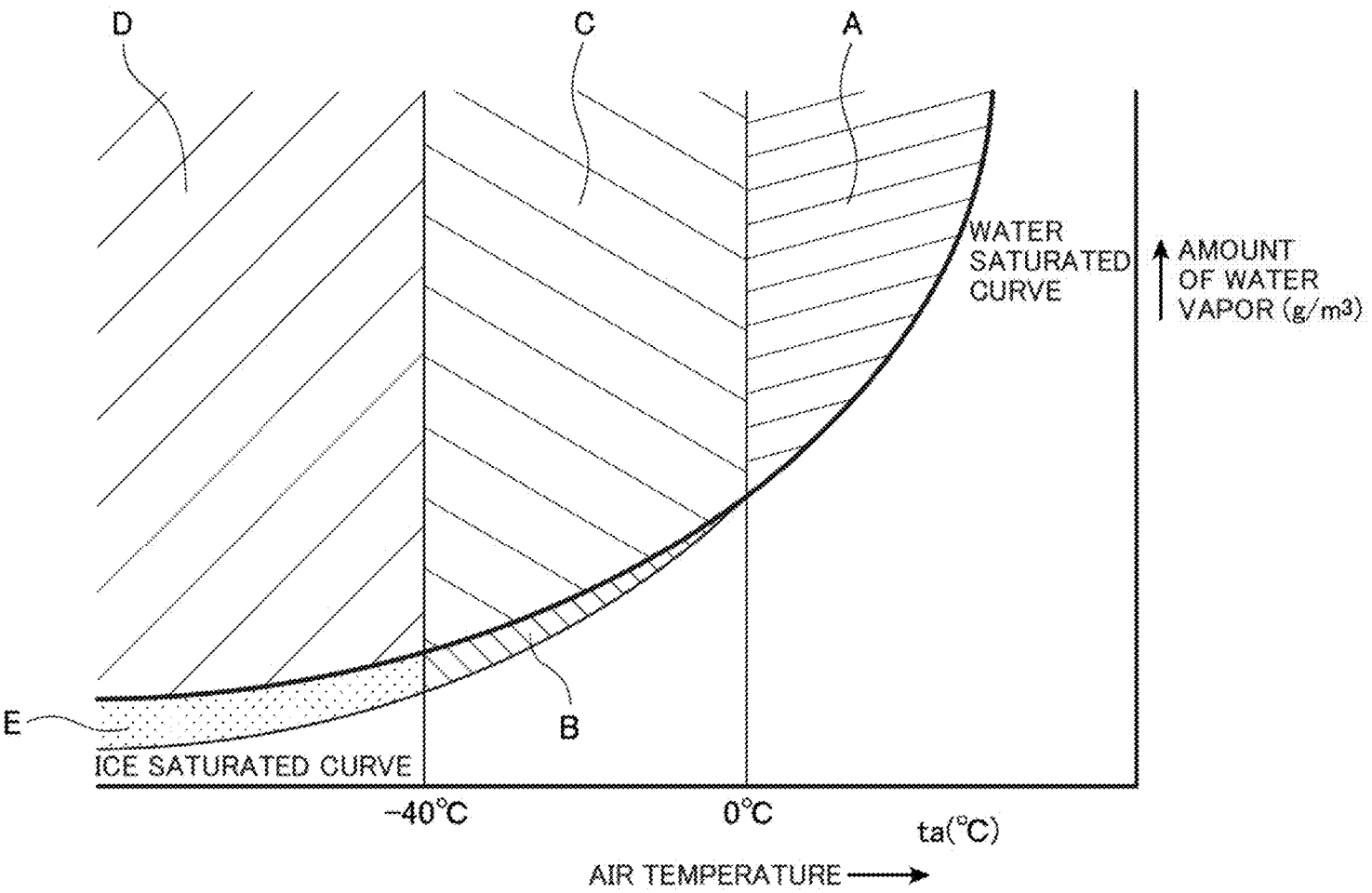
FIG. 3 is a conceptual graph illustrating the occurrence of frost formation and the condensation phenomena using the water saturated and ice saturated curves.

Here, conditions for the occurrence of frost formation, or the condensation phenomenon is explained about, with reference to FIG. 3. If a condition of water vapor in an atmosphere corresponds to a water-saturated atmosphere (including super-saturated state) under air temperature higher than 0° C. (zone A), water droplets are generated by water vapor being condensed to condensation nuclei in an atmosphere, and then, falls and accumulates on the cooling surface, whereby water vapor is condensed to such accumulated water droplets by a repetition of the above growth and combining into one process to form into big droplets. When a gravity force exerting on such big droplets exceeds an adhesion force between the big droplets and the cooling surface, the big droplets flows (falls) down on the cooling surface.

If a condition of water vapor in an atmosphere corresponds to the water-saturated atmosphere (including super-saturated state) under air temperature between 0° C. and −40° C. (zone C), super-cooled water droplets are generated by the water vapor being condensed to condensation nuclei in an atmosphere, and then, fall and accumulate on the cooling surface, whereby the super-cooled water droplets grow to be joined to each other, and then, become frozen, and as a result, the water vapor sublimates to the frozen ice particles to cause the formation of frost.

If a condition of water vapor in an atmosphere corresponds to an ice super-saturated atmosphere and does not correspond to the water-saturated atmosphere under air temperature between 0° C. and −40° C. (zone B), ice crystals are generated by water vapor being sublimated to sublimation nuclei in the atmosphere, and then, falls and accumulates on the cooling surface, whereby water vapor are sublimated to such accumulated ice crystals to cause the formation of frost.

Now, the condensation or the sublimation phenomenon is explained about in more detail. When a moist air is cooled, water vapor in the atmosphere becomes a super-saturated state (refer to as a water super-saturated state) in which the water vapor cannot maintain its gas state any longer, so that the condensation phenomenon sets in. An air temperature at this state is referred to as dew point. In addition, in a case where an ambient temperature is below 0° C., the water vapor can become either an ice super-saturated state or a water super-saturated state. This is because the amount of super-saturated water vapor under the ice state is smaller than that under the water state, the ice super-saturated phenomenon precedes over the water super-saturated phenomenon, so that the water vapor over the amount of the super-saturated water vapor emerges as ice crystals (referred to as ice crystal hereinafter) by sublimating to the ice crystal nuclei in the atmosphere. An air temperature at the stage is referred to as a freezing point.

In this connection, if the water vapor is further cooled under a low temperature to become a water super-saturated condition where a condensation phenomenon sets in, like the case of the air temperature above 0° C., however, under the condition of the air temperature is below −40° C., the condensed droplets immediately become the super-cooled droplets without being frozen. An air temperature at the stage is also referred to as dew point, like a case of the air temperature above 0° C. The super-cooled droplets stochastically become frozen with time. Since the water vapor pressure of the ice is lower than that of the surroundings, water vapor positively sublimates to such an icy surface, whereby frost crystals P4 rapidly start to grow.

In addition, in a case where a condition of the water vapor in the atmosphere corresponds to the water-saturated atmosphere (including super-saturated state) under the condition that the air temperature is below −40° C. (zone D), the water vapor is caused to condensate to the condensation nuclei in the atmosphere to immediately form into frozen particles, and then, frozen particles having fallen and accumulated on the cooling surface to form frost in a powder form.

In this connection, if the temperature of the cooling surface is below −40° C., but the air temperature in the atmosphere is above −40° C. warmer than the cooling surface, the accumulated powder frost gets thick, and if the temperature of the surface of the frost layer becomes above −40° C. due to that it is exposed to the atmosphere, water vapor sublimates to the frost to cause the formation and the growth of the frost.

Further, in a case where a condition of the water vapor in the atmosphere correspond s to the ice super-saturated state and does not correspond to the water-saturated state under the condition that the air temperature is below −40° C. (zone E), the water vapor is caused to sublimate to sublimation nuclei in the atmosphere to immediately form into ice crystals, and then, the water vapor sublimates to ice crystals having fallen and accumulated on the cooling surface to form frost.

In this connection, the above explanation is based on the assumption that the condensation nuclei or the sublimation nuclei exist in the atmosphere within the temperature boundary layer BL near the cooling surface. However, since the condensation nuclei or the sublimation nuclei also exist on the heat exchange surface S, the condensation or the sublimation phenomenon can directly occur on the heat exchange surface S. This follows that, even if the super-saturated phenomenon does not occur in the air, the condensation or the sublimation phenomenon can occur on the heat exchange surface S, only if the condition of the heat exchange surface S corresponds to the surroundings.

That is to say, even if the surroundings of the heat exchange surface S does not correspond to the super-saturated state, the condensation or the sublimation phenomenon can occur only on the surface of the carrier C, so long as the surface of the carrier C corresponds to the super-saturated state.

(2) As to Phenomenon in which Frost Forms on Carrier C within Temperature Boundary Layer BL and does not Grow on Heat Exchange Surface S The above phenomena has not been made clear yet, but is surmised as follows.

Explaining about a case where temperature is above −40° C. at which the super-cooled state occurs, since many condensation or sublimation nuclei exists at the initial stage in the atmosphere including the carrier C, as shown in FIG. 4(A), a super-saturated state occurs, so that condensed droplets P1 in the atmosphere begin to float. Thereafter, as shown in FIG. 4(B), the condensed droplets P1 accumulate on the surface of the carrier C and the heat exchange surface S, and then, they grow on the heat exchange surface S due to the condensation or the sublimation of newly fed water vapor.

Figure 4:
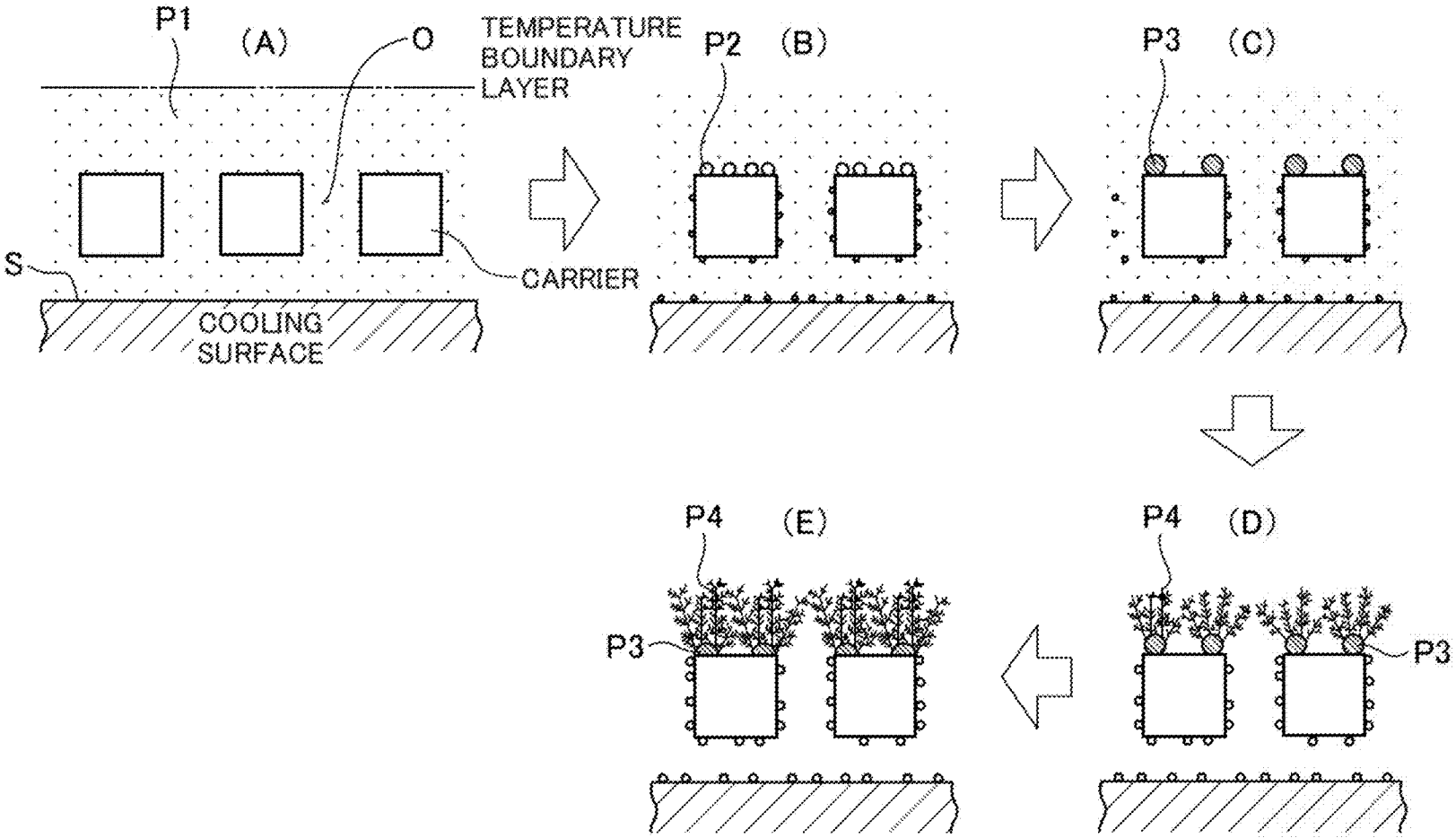
FIG. 4 is a schematic view illustrating a situation in which the frost is formed on the carrier C, in the first embodiment of the present invention.

Then, as shown in FIG. 4(C), the condensed droplets P1 grow into big super-cooled water droplets P3 by a repetition of the above joint, and the big super-cooled water droplets P3 becomes frozen particles. At this stage, as shown in FIG. 4 (D), water vapor in the air sublimates to the frozen particles, so that the frost begins to grow. Since a rapid growth of the frost on the surface of the carrier C begins, water vapor is caught by the surface of the carrier C, so that the amount of water vapor flowing into the atmosphere on the heat exchange surface S decreases, whereby the super-saturated phenomenon is mitigated.

Then, as shown in FIG. 4(E), since the frost grows at an upper area between the carriers C, a large amount of water vapor becomes unable to flow into an space between the carrier C and the heat exchange surface S, and as a result, water vapor forms into the frost on the surface of the carrier C, while, water vapor does not form into the frost on the heat exchange surface S. In this connection, since the sensible heat exchange without the formation of the frost can be maintained on the heat exchange surface S due to the fact that the convection current still exists, the amount of the sensible heat exchange can be maintained at the same level as that at the initial stage. A best heat exchange configuration can be achieved by a combination of this sensible heat exchange through the heat exchange surface S and the latent heat exchange through the surface of the carrier C.

In this connection, although the above phenomenon occurred by arranging the surface of the carrier C parallel to the heat exchange surface S was explained about, the above phenomenon is attributed to the mechanism in which the formation of the frost on the heat exchange surface S can be prevented due to the fact that the water vapor does not form the super-saturated state on the heat exchange surface S. Accordingly, even if a heat transfer promoter N for promoting the heat transfer through the heat exchange surface S constituting a flow for destroying the temperature boundary layer is utilized, the sensible heat transfer can be promoted by removing water vapor by means of the carrier C at last, since the heat transfer by the convection current can be increased.

Figure 5A:
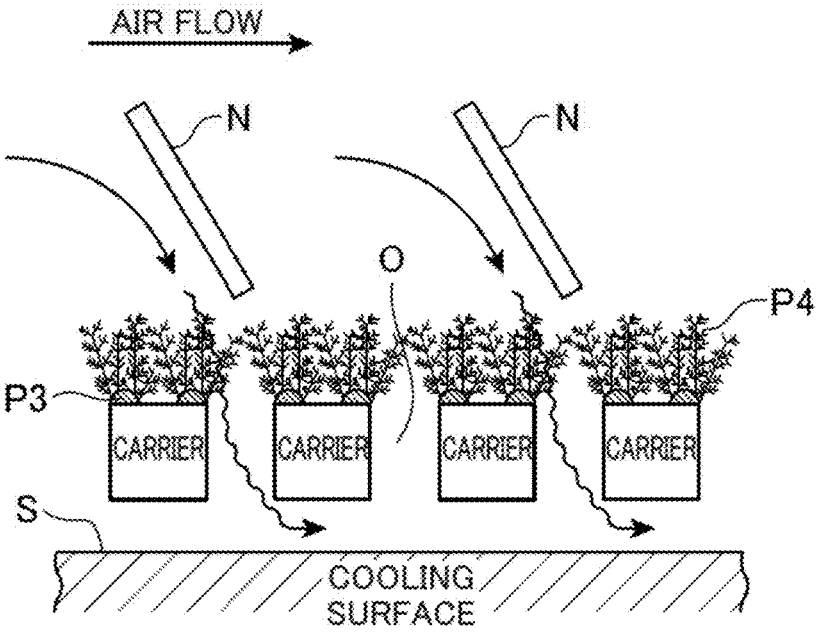
FIG. 5A is a schematic view illustrating an alternative of the carrier C in the first embodiment of the present invention.
Figure 5B:
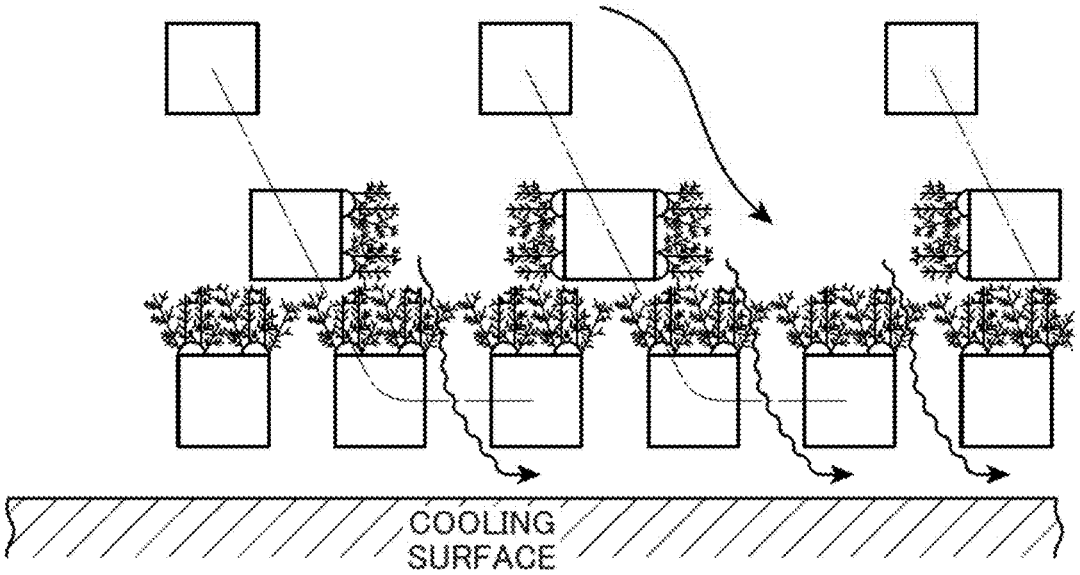
FIG. 5B is a schematic view illustrating an alternative of the carrier C in the first embodiment of the present invention.

For example, as shown in FIG. 5(A), if the heat transfer promoter N in a plate form is disposed outside the carrier C, a portion of a flow of the fluid is guided to the side of the carrier C to promote the flow of the fluid passing thorough the openings O of the carrier C, whereby the formation of the frost on the heat exchange surface S and the heat transfer through the heat exchange surface S can be promoted. In FIG. 5(B), the structure of the carrier C and the heat transfer promoter N in FIG. 5(A) is constituted only by the carrier C. A plurality of the normal planar carriers C are separated from each other in the flow direction in such a way that only a portion at the upstream side is disposed outside of the temperature boundary layer.

Figure 6A:
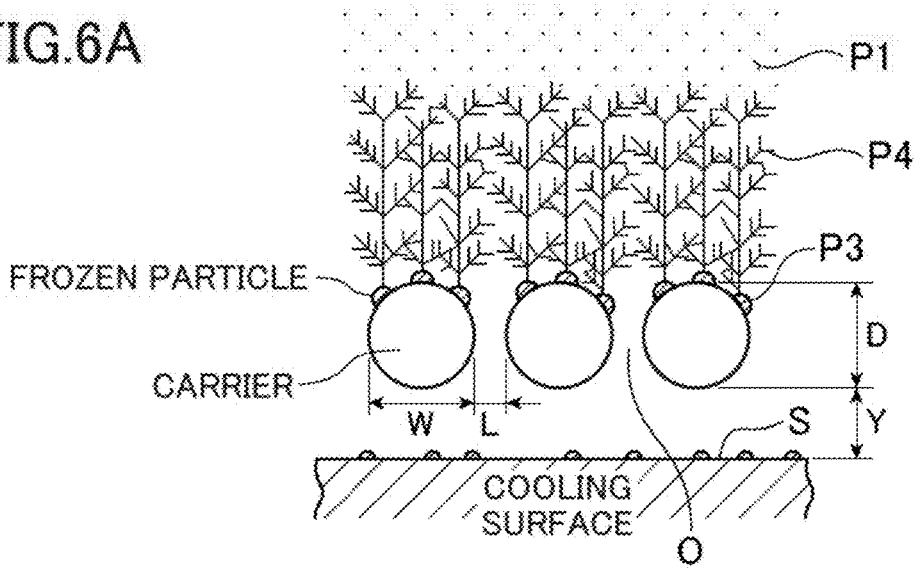
FIG. 6A is a schematic view illustrating a further alternative of the carrier C in the first embodiment of the present invention.
Figure 6B:
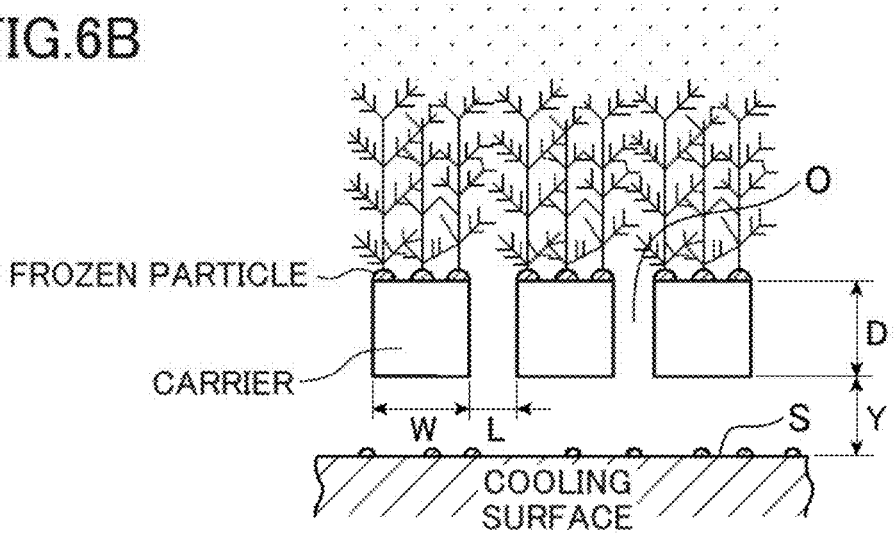
FIG. 6B is a schematic view illustrating a further alternative of the carrier C in the first embodiment of the present invention.
Figure 6C:
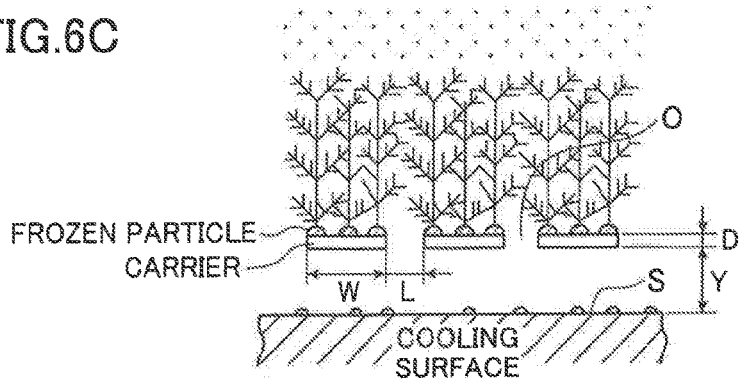
FIG. 6C is a schematic view illustrating an alternative of the carrier C in the first embodiment of the present invention.

(3) Relationship Between Shape, Size and Opening O of Carrier C, and Heat Exchange Surface S Under Growing Phenomena of Frost The relationship between the shape, the size and the opening O of the carrier C, and the heat exchange surface S is now explained about, with reference to FIGS. 6(A) to 6(C).

In a case where the growth of the frost in the atmosphere the temperature of which is between 0° C. and −40° C., the carrier C may be sized in such a way that condensed water droplets accumulates to form a group of the super-cooled water droplets P3 and may have any cross section shape. The opening O may be sized in such a way that the frost layer having grown on the carrier C closes the opening O at the growing stage.

The opening O between the adjacent carriers C may be blocked by the growth of the frost on the adjacent carriers C.

In addition, the depth of the carrier C may be any, so long as a space between the carrier C and the heat exchange surface S is kept.

In a case where the carrier C is provided on the heat exchange surface S, since an area for the sensible heat exchange through the heat exchange surface S decreases, it is considered to be important that the carrier C is kept away from the heat exchange surface S in a case where the latent heat exchange and the sensible heat exchange are intended to be separated from each other by means of the carrier C.

In this connection, it was explained that the provision of the space between the heat exchange surface S and the carrier C matters for the water vapor passing through the opening O, and this is assumed that an invasion of the water vapor into the illustrated space from the right and the left side thereof does not occur.

Since there are various kinds of configurations of the heat exchange surface S depending on the heat exchanger HX, the concrete explanation of the heat exchange surface S is omitted here, but, needless to say, the configuration of the heat exchanger HX is selected so as to prevent such an invasion of the water vapor.

Examples of the cross sectional shapes of the carrier C is shown in FIGS. 6(A), 6(B), and 6(C). Any cross sectional shape of the carrier C can be adopted, as shown in FIGS. 6A, 6B, and 6C. Since the carrier C includes the openings O, the openings O can be formed by a mechanical cutting operation, an electric discharge machining, a sandblasting method, an etching method, etc., or by a pressing machining. Any method can be adopted. In addition, a wire in a meshed form such as a metal mesh, or a punching metal, a metal lath (expand metal) can be utilized.

Figure 7A:
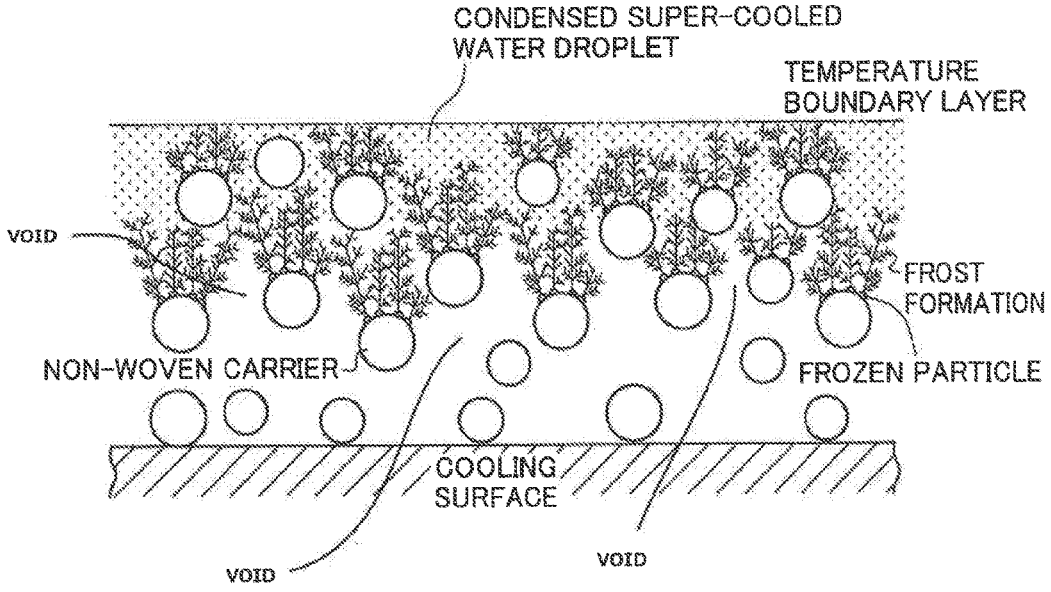
FIG. 7A is a schematic view illustrating an alternative of the carrier C in the first embodiment of the present invention.

With respect to the size of the carrier C, the width of the carrier C is between 100 μm and 2000 μm, the width L of the opening O is between 100 μm and 1000 μm, and the depth between the surface of the carrier C and the heat exchange surface S is above 100 μm. In addition, since the carriers C do not have to be arranged in a planar manner, the carrier C in a non-woven form can be adopted, as shown in FIG. 7A. According to such a non-woven carrier C, it is technically advantageous to attain a sufficient function without providing gaps on the heat exchange surface S.

Figure 7B:
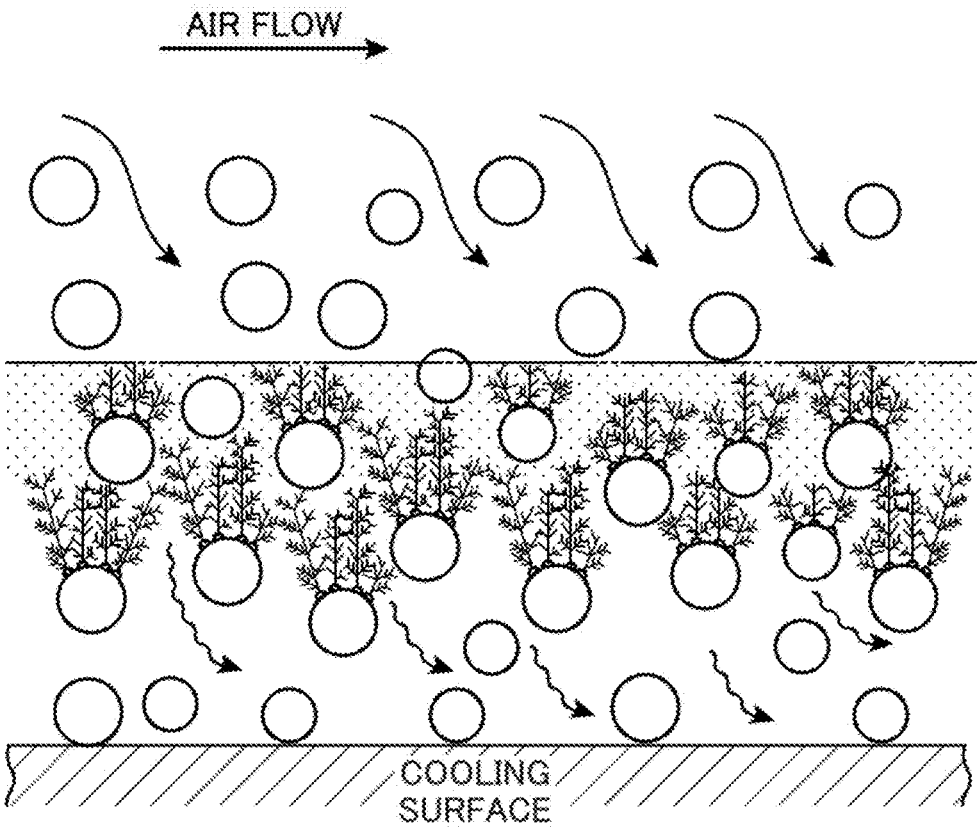
FIG. 7B is a schematic view illustrating an alternative of the carrier C in the first embodiment of the present invention.

In addition, as shown in FIG. 7B in which the carrier C is disposed outside the temperature boundary layer BL, a portion of the carrier C outside the temperature boundary layer BL can be functioned as the heat transfer promoter N.

(4) Treatment of Frost Having Grown on Surface of Carrier C

It is fundamentally crucial that by the dehumidification of the carrier C by means of the condensation or the sublimation, to suppress the condensation or the sublimation on the heat exchange surface S, and one more important matter is how to treat the frost having grown on the surface of the carrier C under the condition of the temperature below 0° C. Since the frost grows thick to form into a thermal resistance layer with time, whereby the growth of the frost decreases while the air-passage is hindered, and as a result, the heat transfer is deteriorated, the treatment of the frost is needed to maintain the heat transfer.

The treatment of the frost differs in accordance with "the preservation of the heat exchange surface S", "the utilization of the frost" and "the separation of the latent heat exchange and the sensible heat exchange"

The target of each of "the preservation of the heat exchange surface S" and "the separation of the latent heat exchange and the sensible heat exchange" is the heat exchange surface S itself or to exchange heat through the heat exchange surface S and the surface of the carrier C, and has nothing to do with the treatment of the frost itself.

Accordingly, there are various kinds of methods for attaining the above target, since any treatment of the frost does not matter.

That is to say, conventional defrosting methods (hot gas, water sprinkling, off-cycle defrosting, an electrical heater, brine sprinkling, etc.) can be adopted. A new idea of a utilization of jet flow by an air nozzle, or a mechanical process by using a brush can be adopted. The technique of vibrating the carrier C also can be adopted.

In case of "the utilization of the frost", a secondary utilization of the frost is needed under a concept that the frost is deemed a heat storing body. More specifically, the carrier C on which the frost has grown with time is replaced by a new carrier C on which no frost is formed, and the replaced carrier C with frost is utilized on the spot, or moved to a place where the frost is peeled off from the surface of the carrier C by the physical method such as the jet flow, the vibration, or the mechanical method such as the brush to be utilized for a certain application. In addition, in a case where the frost is utilized for the heat storing body, the carrier C with frost can be utilized as it is, in accordance with applications.

In case of "the separation of the latent heat exchange and the sensible heat exchange", the carrier C may be replaced, since the frost needs to be treated highly efficiently due to the formation of the frost on the surface of the carrier C in order to maintain the high efficiency of the latent heat exchange.

Figure 8:
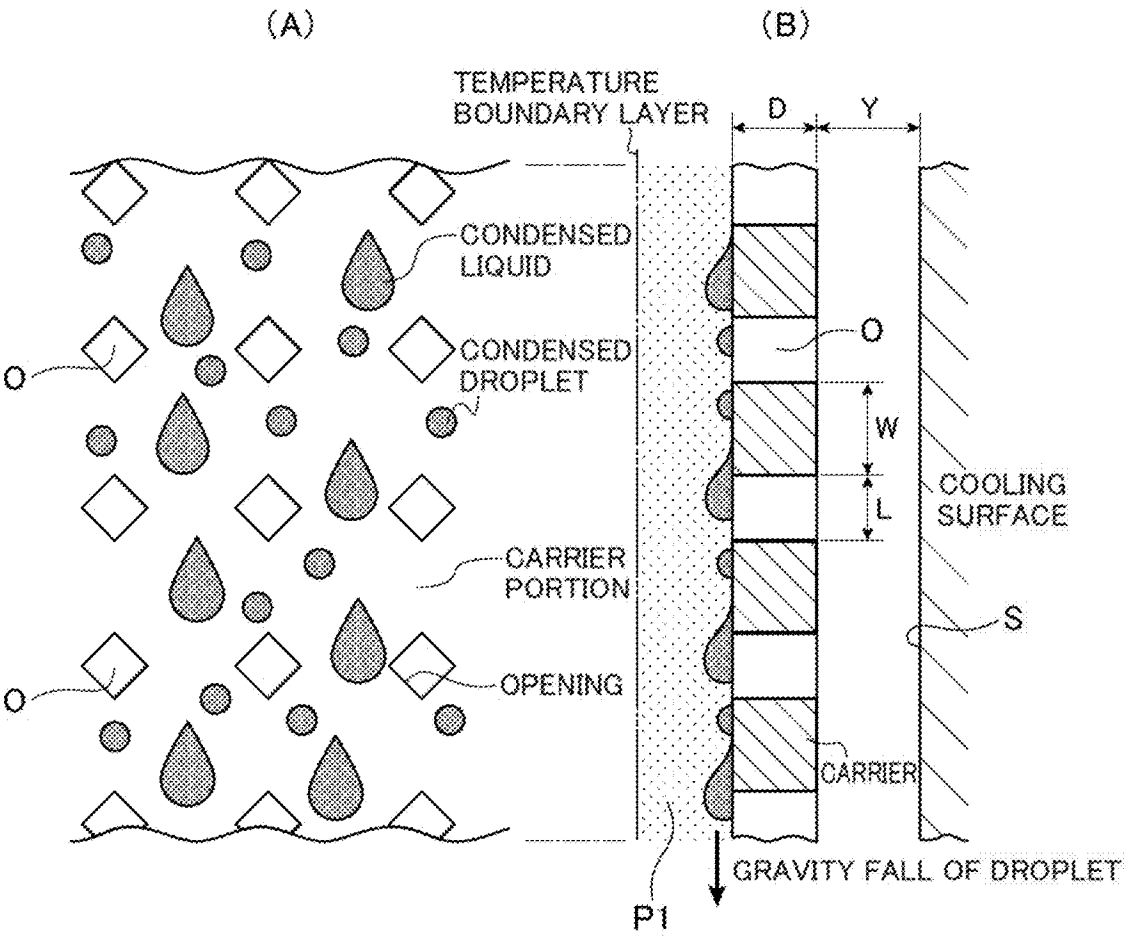
FIG. 8 is a conceptual view illustrating a condensation phenomenon on the surface of the carrier C and the heat exchange surface S in a second embodiment of the present invention.

A second embodiment of the present invention is now explained about, with reference to FIG. 8. The technical feature of this embodiment lies in the fact that the relationship between the carrier C and the heat exchange surface S under the dropwise condensation state is specified.

With respect to the relationship between the carrier C and the heat exchange surface S under the dropwise condensation phenomenon occurring at the temperature above 0° C., the heat exchange surface S is oriented to be vertical. This vertical orientation is needed in order for the condensed droplets P1 to drop by gravity. As shown in FIG. 8, a general technical problem of the condensation phenomena on the heat exchange surface S is the decrease of the heat transfer through the heat exchange surface S due to the formation of a water membrane on the heat exchange surface S caused by a surface tension of the condensed droplets P1. In this embodiment, a good heat exchange can be maintained without the formation of such a water membrane by disposing the carrier C within the temperature boundary layer BL of the heat exchange surface S so as to treat the condensed droplets P1 on the surface of the carrier C to drop them by gravity.

Since the latent heat exchange due to the condensation phenomena on the surface of the carrier C is added, the heat exchange can be improved, as compared with a case of the heat exchange only on the heat exchange surface S. In this connection, the generation of dew can be caused to improve the heat transfer based on the condensation by effecting the water repellent finishing on the surface of the carrier C, while at the same time, a good condensation phenomena can be caused, since the condensed droplets with small diameters can drop by gravity. In addition, the plugging of the opening O by the condensed droplets can be prevented.

With respect to the relationship among the width W of the carrier C, the width L of the opening O, and the depth, it is considered that the size of the opening O needs to be smaller than that is needed for the formation of the frost, since a secondary growth of the frost so as to plug the opening O is not expected to occur, unlike the first embodiment, so that the water droplets tend to easily reach the heat exchange surface S through the opening O. In this connection, it is surmised that the positive generation of dew on the heat exchange surface S is halted, since the condensation on the surface of the carrier C decreases the water vapor in the atmosphere, so that the water droplets having passed through the opening O in the atmosphere of the space between the heat exchange surface S and the carrier C are reduced.

Embodiment

The inventors confirmed the effectiveness of the present invention by carrying out an experiment concerning the suppression of the frost crystals P4 in which a micro object is disposed within the temperature boundary layer to utilize the condensation and the solidification occurring within the temperature boundary layer to grow the frost crystals P4 within temperature boundary layer to control their growth, with a view to realizing a phenomenon in which the frost crystals P4 is not adhered on the heat exchange surface S.

Experiment Equipment and Method

In this research, the suppression of the formation of the frost on the heat exchange surface S was studied by a metal mesh being disposed within the temperature boundary layer BL to cause the frost crystals P4 to grow on the metal mesh.

An experimental small chamber, a thermostatic system for maintaining the temperature and the humidity in the experimental small chamber constant, a measurement system, an observation system, and a heat transfer section are provided. The temperature and the humidity in the experimental small chamber are controlled by an air conditioner, a humidifier, a dehumidifier and a heater, while the temperature and the humidity in the experimental chamber are measured by an Asman wet-and-dry bulb thermometer disposed in the experimental small chamber.

(1-1) Observation of Frost Crystals P4

Figure 9:
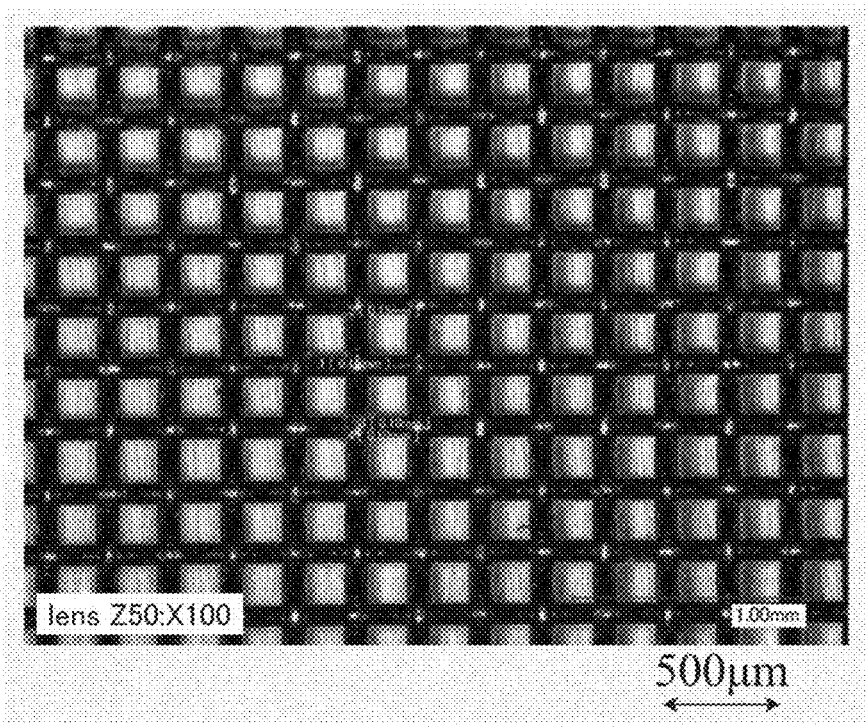
FIG. 9 is a planar photograph illustrating a metal net in the embodiment of the present invention.
Figure 10:
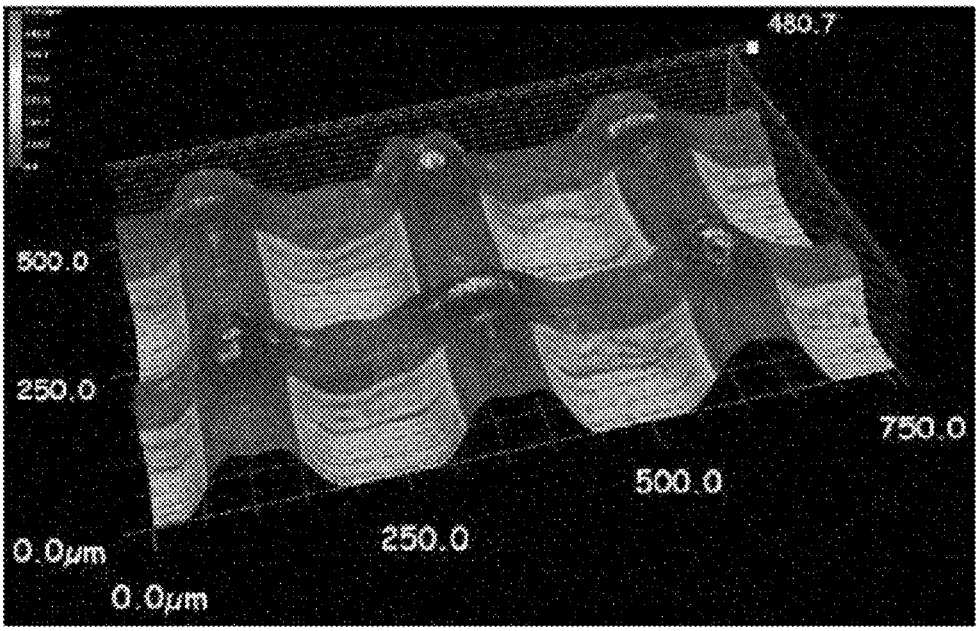
FIG. 10 is a three-dimensional image illustrating the metal net in the embodiment of the present invention.

FIGS. 9 and 10 show a photograph and a three-dimensional image of the metal mesh used in this research. The metal mesh is planar-woven with 100 μm diameter made of steel (SUS304) wires and has an aperture of 150 μm.

The heat exchange surface S is made of oxygen-free cupper and polished into a mirror surface (angle of contact by static droplet, θ=62°), and the metal mesh in FIG. 10 is rested and fixed on the heat exchange surface S. In addition, a space is provided between the heat exchange surface S and the metal mesh and the micro object is disposed within the temperature boundary layer.

The observations of the formation and the growth of the frost crystals P4 were made with a digital microscope, focusing both on the heat exchange surface S and the metal mesh, and digitally recording the images. Analytical software was then used to analyze the recorded images.

The observation experiments were carried out under the following conditions: heat exchange surface temperature tw=−25° C., the heat exchange surface S (upward-facing) orientation θ=0°.

(1-2) Heat Flux

The frosting phenomenon is a transient process because the frost layer changes with time. It should be noted that the present experiments were conducted under the condition that the heat exchange surface temperature changed with time. The heat flux of [W/m2] on the surface was obtained by using the recorded temperature and the lumped-thermal-mass approximation, which is possible because the heat exchange surface is made of oxygen-free copper.

Figure 11:
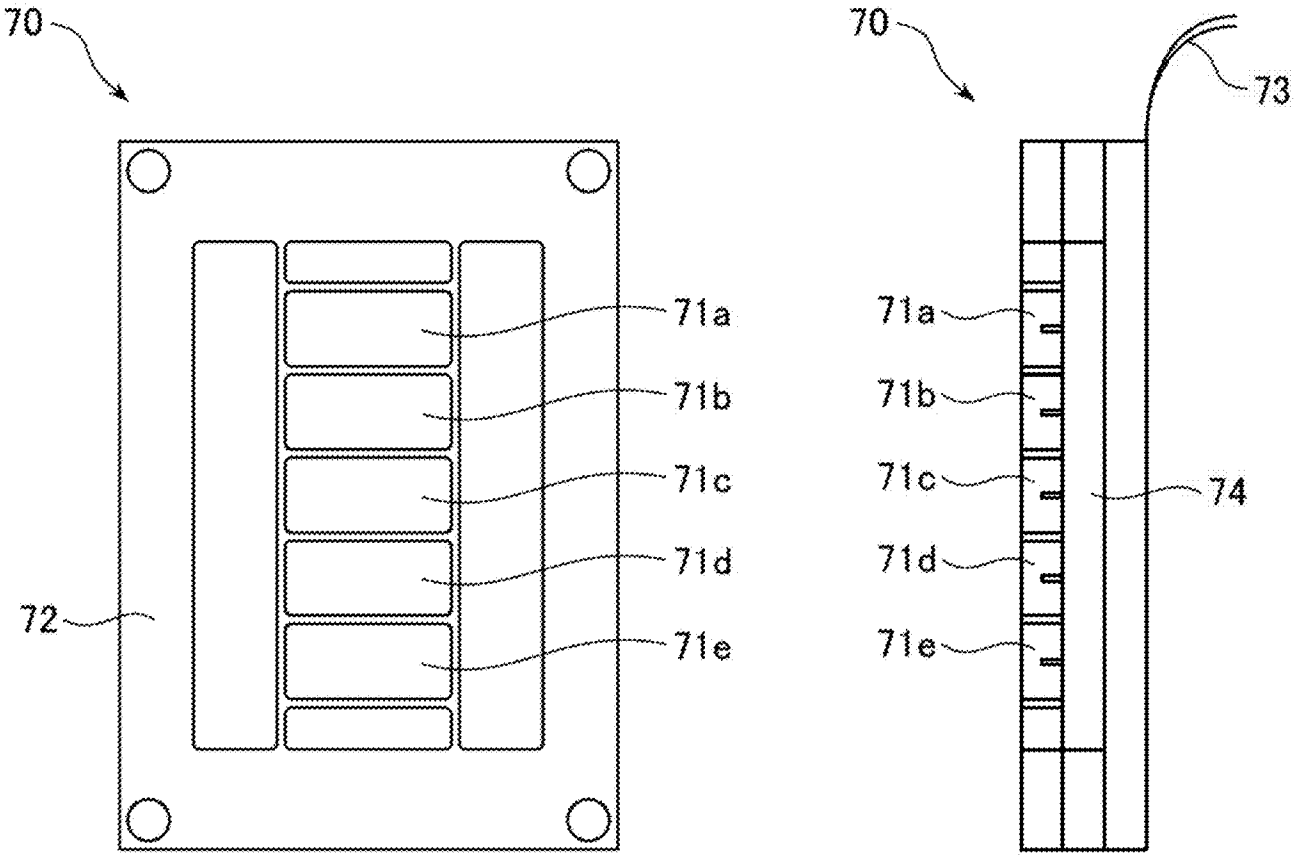
FIG. 11 is a plan view and a side view each illustrating the metal net in the embodiment of the present invention.

FIG. 11 shows a schematic diagram of the heat exchange surface. The heat exchange surface consists of 5 oxygen-free cupper plates, each 40 mm wide, 18 mm long, and 10 mm thick. The heat exchange surface is flat and has been polished sufficiently. The sides and the rear of these plates have been insulted with fabric-laminated Bakelite. Further, the rear side of the plates have been thermally insulated with Isowool (having a heat conduction ratio k=0.07 W/m/K at 400° C.). In order to reduce heat transfer from Bakelite into the cooling surface as much as possible, oxygen-free copper plates have been embedded into the heat exchange surface. Note that care has been taken to prevent frost formation on the cooling surface during its initial cooling to a predetermined temperature and before the start of the experiment by covering the heat exchange surface with a polyethylene sheet. To cool the heat transfer section to a predetermined temperature, it was dipped in a Dewar filled with liquid ethanol, which is cooled by liquid nitrogen to a desired temperature. Next, the heat exchange surface was maintained at the predetermined temperature for 10 minutes, and was placed to be oriented vertically in the experimental small chamber to start the experiment. Additional experiments have been carried under each experimental condition with the heat transfer section covered by an insulating member to evaluate the heat loss, which is necessary for the accurate evaluation of the heat flux.

The heat-flux experiments were carried out under the following conditions: moist air temperature, to =−25° C.; initial heat exchange surface temperature tw=−40° C.; wettability of heat exchange surface or angle of contact, θ=62°; and at distance from the leading edge of the heat exchange surface, y=41, 61, 81 and 101 mm.

(2) Experimental Result and Study (2-1) Mechanism of Formation and Growth of Frost Crystals P4

The inventors paid attention to the size of the super-cooled water droplets P3 to vary the configuration of the heat exchange surface S by artificially providing fine concave and convex surfaces with several hundred μm on the heat exchange surface S, and as a result, succeeded in preventing the frost crystals P4 from growing on the heat exchange surface S (a portion of the heat exchange surface S).

Figure 12:
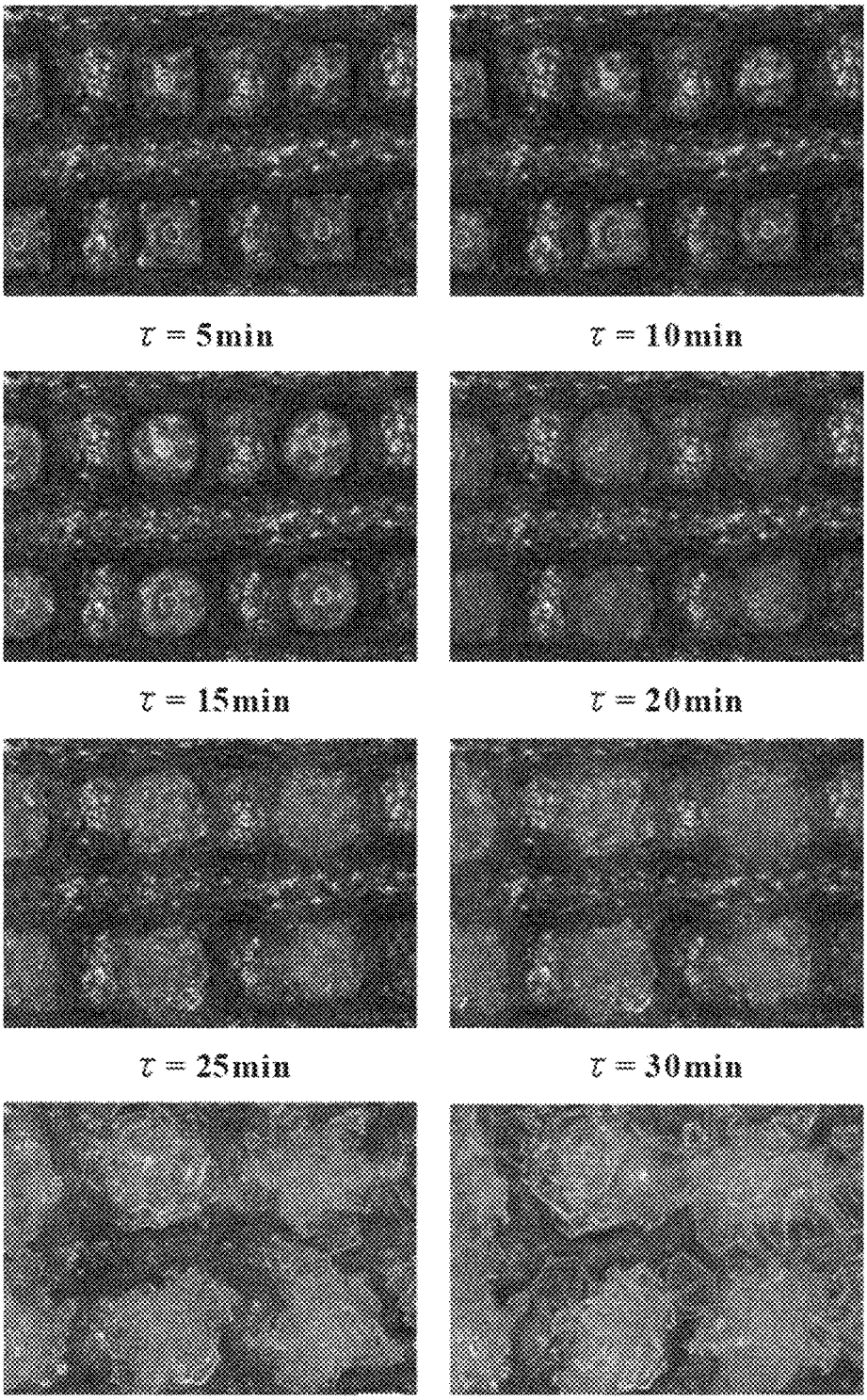
FIG. 12 is a view illustrating the process in which the frost crystals P4 grow in a case where the heat exchange surface S is groove-machined.

At present, the area in which the frost crystals P4 are not formed amounts to 75% of the entire heat exchange surface S. FIG. 12 shows a typical example of an observation result of the process of the formation and the growth of the frost crystals P4, in a case where fine grooves in a mesh form are machined on the cooling surface.

In a case where the fine grooves in a mesh form are machined, although the convex portion is shaped to be a square, the super-cooled water droplets P3 are generated on the convex surface to be coalesced into big droplets with time after the start of the experiment. The super-cooled water droplets P3 having repeatedly coalesced becomes a single droplet on the square convex surface to form into a protruded plateau ice after the super-cooled state is lost.

The super-cooled state lasts up to fifteen minutes after the start of the experiment, based on the fact that a white ring by a light is confirmed on the central portion.

Next, a plurality of the frost crystals P4 are generated from the protruded plateau ice. In this connection, during the growth of the frost crystals P4, the existence of the frost crystals P4 was not confirmed on the groove portion.

Based on the above observation result, we investigated to form the frost crystals P4 within the temperature boundary layer.

Figure 13:
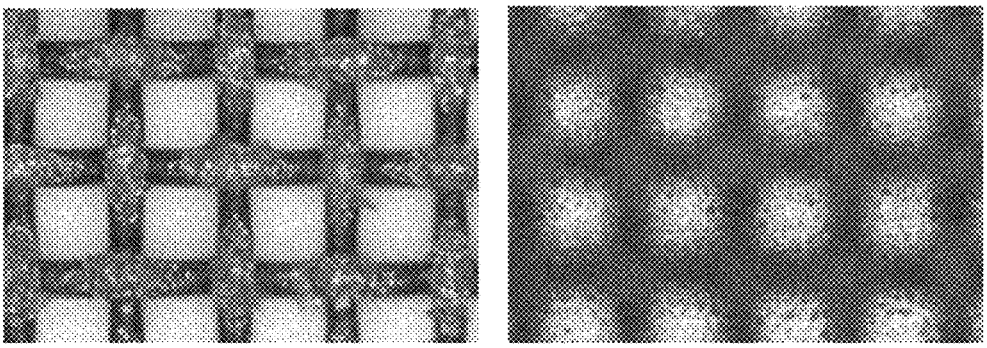
FIG. 13 is a view illustrating the observation result of the formation of the frost crystals P4 in a case where the metal net is disposed on the heat exchange surface S in FIG. 9, in the embodiment of the present invention.
Figure 13:
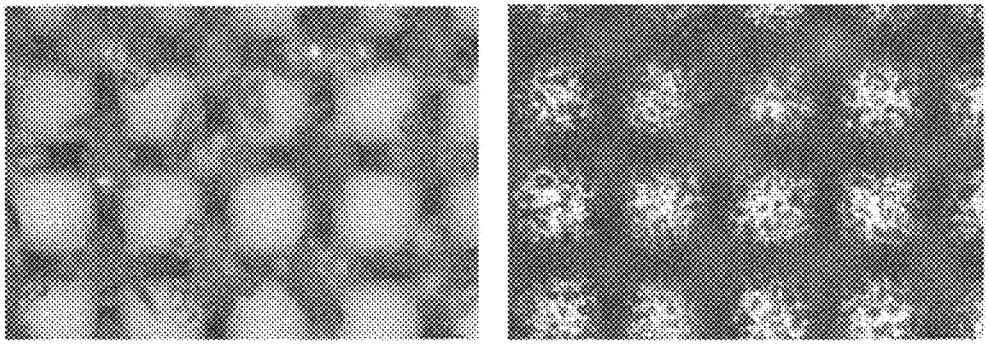
Figure 13:
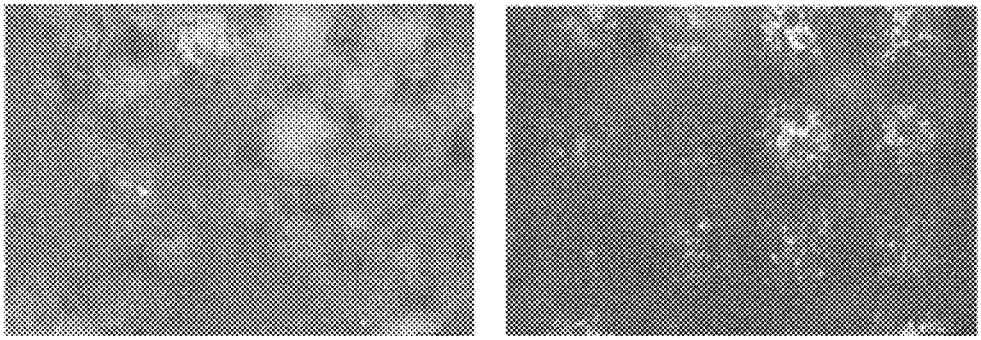

Firstly, a metal mesh with a size substantially same as the convex portion in FIG. 12 is selected as the micro object disposed within the temperature boundary layer and is rested on the heat exchange surface S. FIG. 13 shows an observation result of the formation of the frost crystals P4 in a case where the metal mesh in FIG. 10 is rested on the flat heat exchange surface S. In this connection, the observation was carried out from above. According to the observation, it was confirmed that the super-cooled water droplets P3 are generated on the heat exchange surface S and the surface of the metal mesh, and that a plurality of the frost crystals P4 were generated from the protruded plateau ice on the metal mesh after the loss of the super-cooled state. On the other hand, the frost crystals P4 were not confirmed on the heat exchange surface S.

Figure 14:
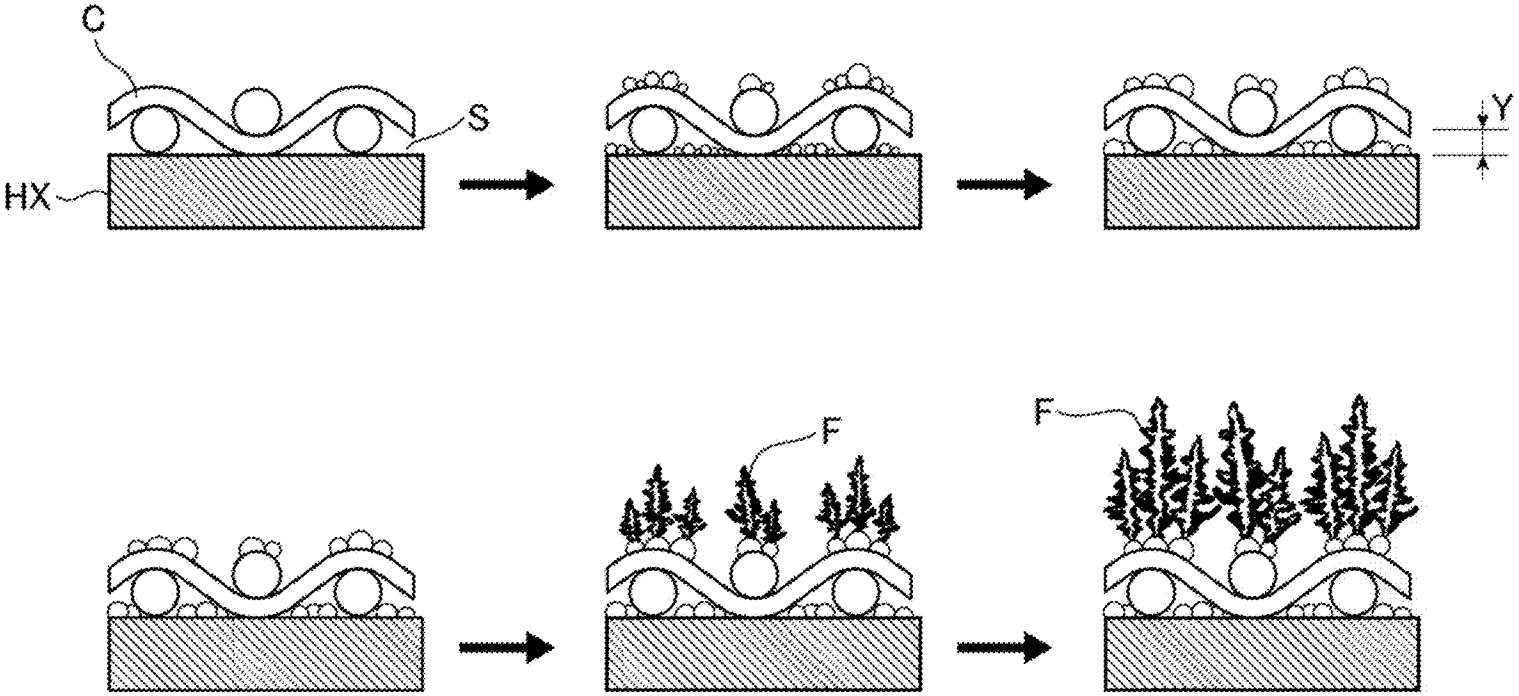
FIG. 14 is a sketch illustrating the formation of the frost crystals P4 and the mechanism of the growth of the frost in FIG. 13.

In addition, when the metal mesh is removed from the heat exchange surface S, the frost formed on the metal mesh immediately melted. Further, the growth of the frost crystals P4 on the heat exchange surface S contacting the metal mesh was not confirmed. FIG. 14 is a sketch illustrating the mechanism of the formation and the growth of the frost crystals P4. The growing speed of the frost crystals P4 is the fastest at the convex portion of the metal mesh, while spherical ice is adhered on the heat exchange surface S after the loss of the super-cooled state, however, the frost crystals P4 was not formed due to the size of the ice being below 150 μm.

Next, the experiment was carried out on the condition that a space between the metal mesh used in the observation with respect to FIG. 13 and the heat exchange surface S was provided.

Figure 15:
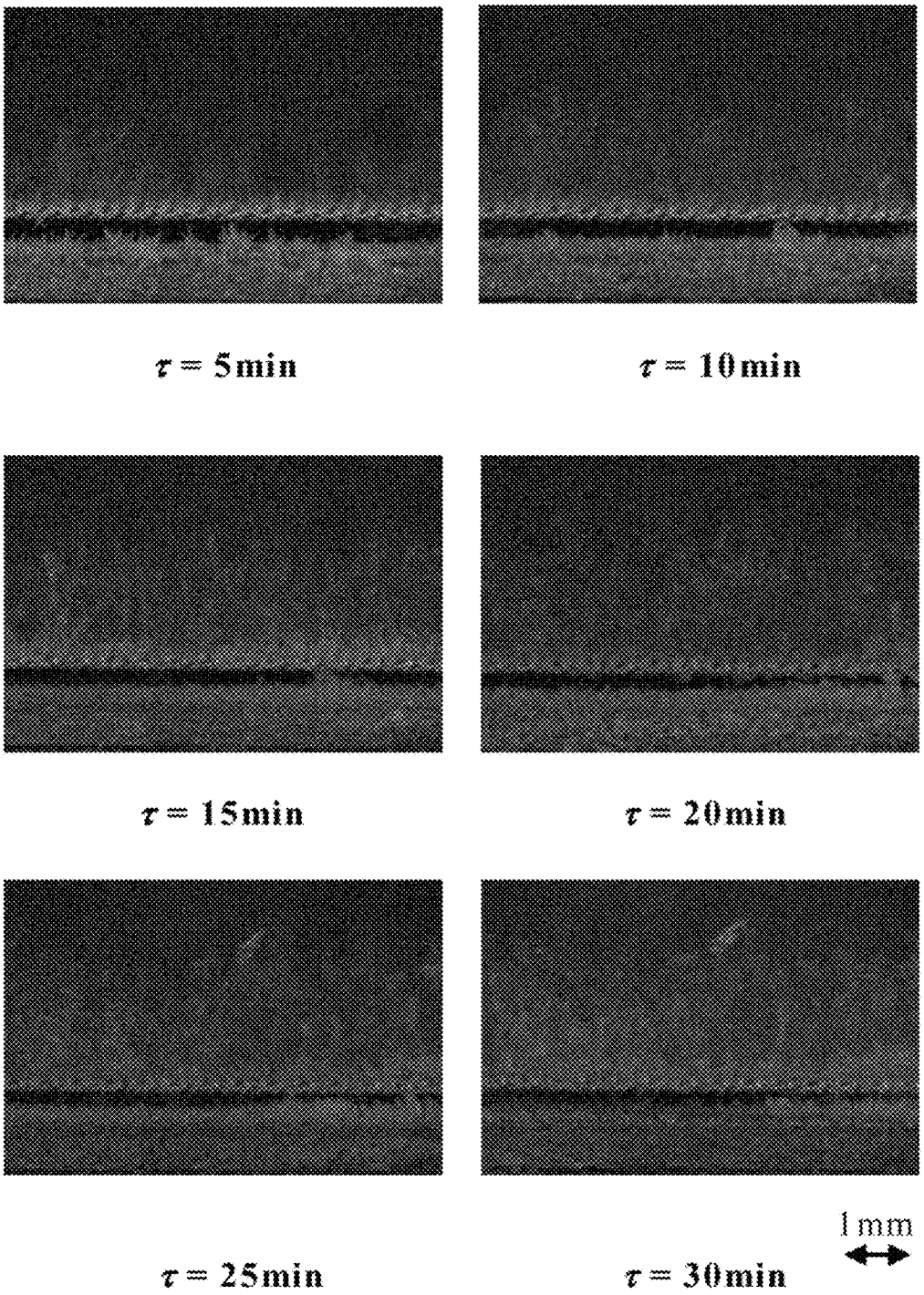
FIG. 15 is a side view illustrating the observation result of the formation of the frost crystals P4 in a case where a gap is provided between the metal net in FIG. 9 and the heat exchange surface S, in the embodiment of the present invention.
Figure 16:
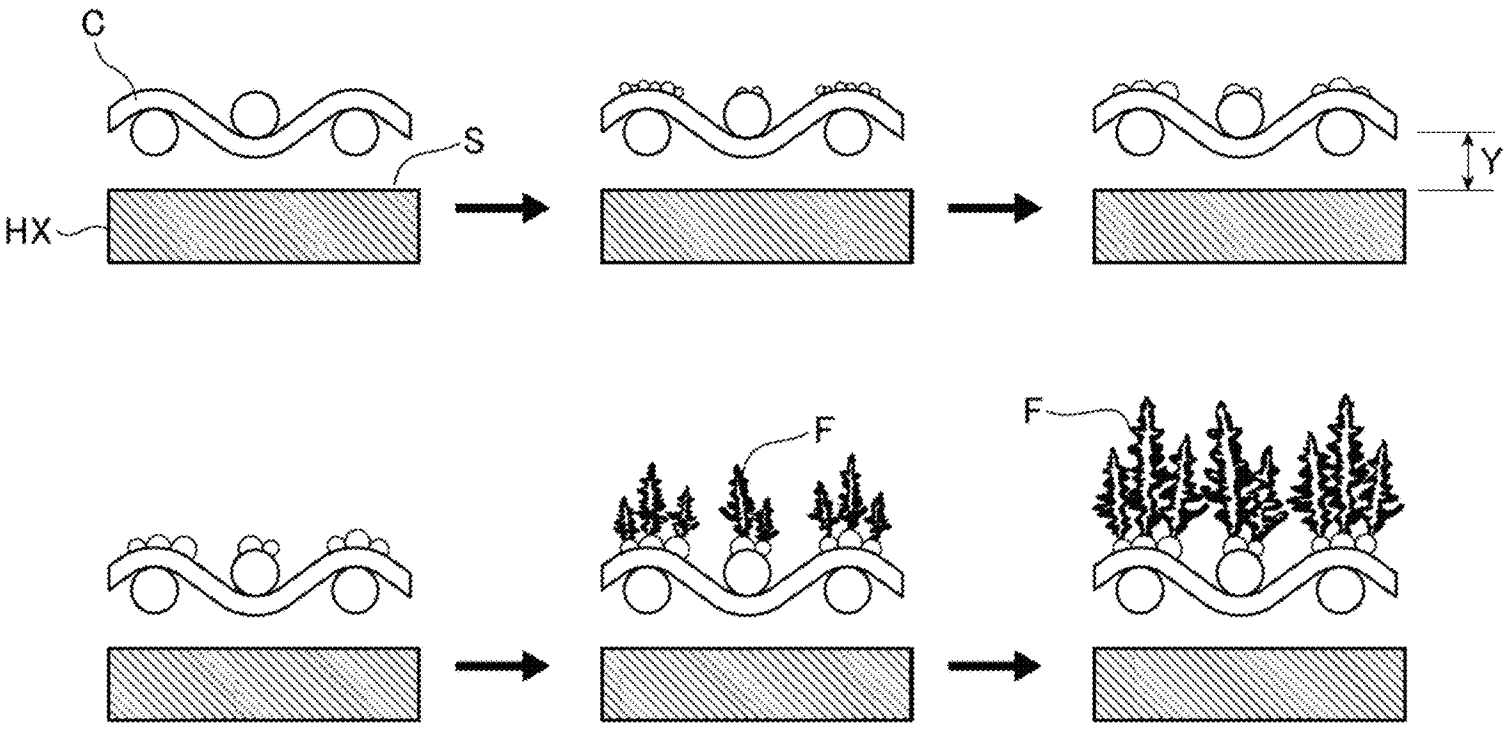
FIG. 16 is a sketch illustrating the formation of the frost crystals P4 and the mechanism of the growth of the frost in FIG. 15.

FIG. 15 shows an observation result from side, and FIG. 16 is a sketch drafted based on the observation result. As shown in FIGS. 15 and 16, it was confirmed that the frost crystals P4 are formed to grow on the surface of the metal mesh, but that the frost crystals P4 are not formed to grow on the heat exchange surface S.

Base on the above results, it is considered that we confirmed the effectiveness of the method of controlling the mechanism of the formation and the growth of the frost crystals P4 proposed by this research. In addition, it is considered that the prevention of the formation of the frost on the heat exchange surface S was accomplished, since the frost layer did not grow on the heat exchange surface S at the time when the metal mesh was removed.

(2-2) Heat Transfer Involving Formation of Frost

Figure 17:
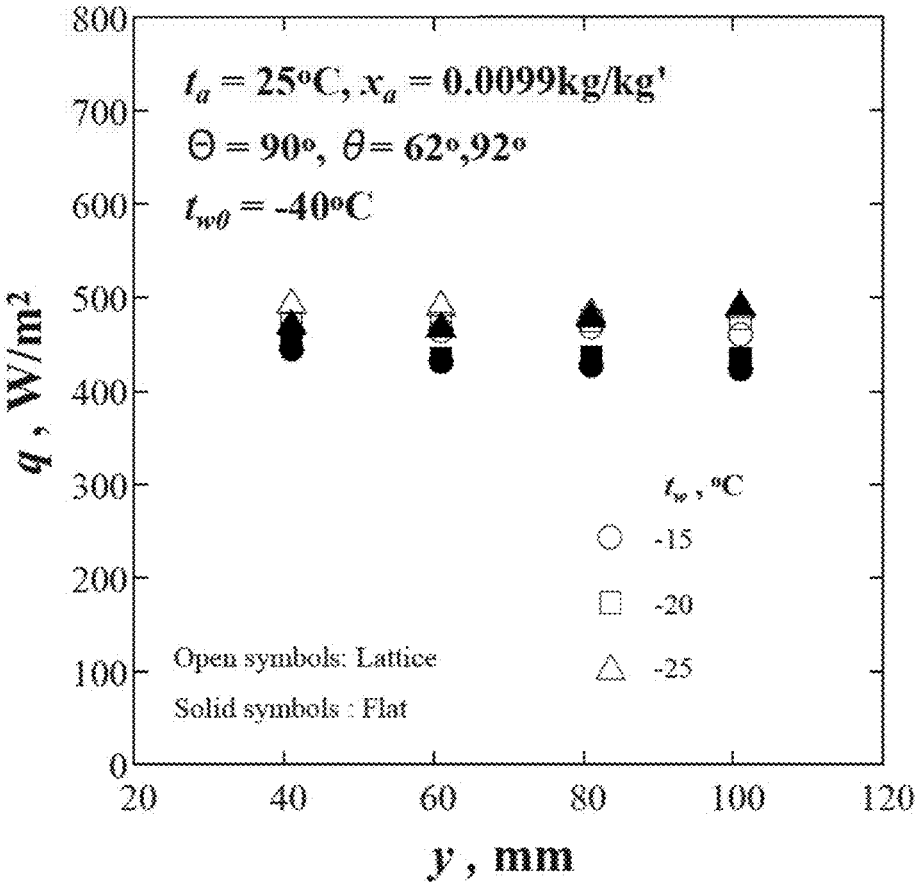
FIG. 17 is a graph illustrating a relationship between the heat flux and the temperature of the heat exchange surface S, in a case where the metal net is disposed within the temperature boundary layer and in a case where the metal net is not disposed within the temperature boundary layer, in the embodiment of the present invention.

The comparison of the experimental result between the case where the metal mesh is disposed within the temperature boundary layer BL and the case where the metal mesh is not disposed within the temperature boundary layer BL (the smooth surface) is carried out. FIG. 17 shows a relationship between a heat flux and a temperature of the heat exchange surface S. In this connection, the temperature of the heat exchange surface S in a case where the metal mesh is attached is not a temperature of the surface of the metal mesh, but that of the surface of the heat transfer portion made of oxygen-free copper. As clearly shown in FIG. 17, it was confirmed that the metal mesh does not influence much on the heat flux, since there is not a peculiar difference of the heat flux between the two cases.

Figure 18:
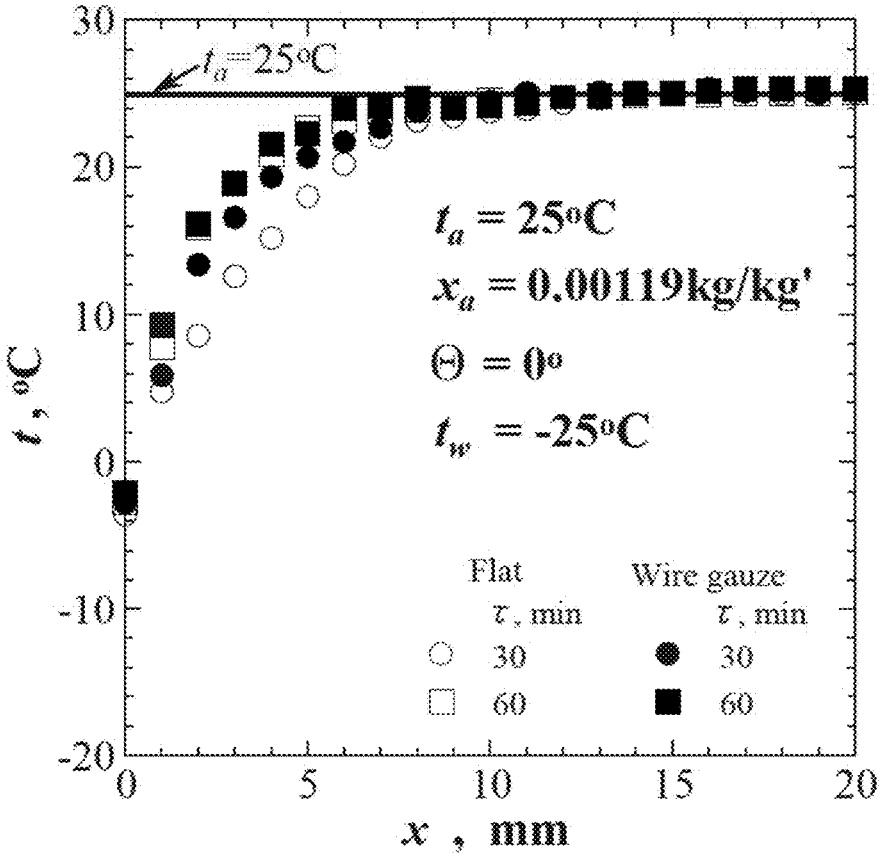
FIG. 18 is a graph illustrating a temperature distribution within the temperature boundary layer BL based on the surface of the frost layer, in the embodiment of the present invention.

FIG. 18 shows a temperature distribution within the temperature boundary layer on the basis of the position of the surface of the frost layer. In this connection, the thickness of the frost layer was measured based on the surface of the frost layer. The heat exchange surface S on which the frost crystals P4 are adhered is oriented to be horizontally upward.

The heat exchange surface S is an end face of a square pillar made of oxygen-free copper with 50 mm wide, 50 mm long, and a copper plate with the thickness of 1 mm is adhered to the end face by epoxy adhesion to form the heat exchange surface. The temperature of the surface of the heat exchange surface S is measured by adhering CA thermocouple (diameter: 100 μm) to the underside of the copper plate. The temperature of the surface of frost layer is measured by a thermocouple. The thermocouple is attached in an arc form to a support portion made of Bakelite with a thermal insulating effect to be mounted on a traverse device horizontally and vertically movable relative to the heat exchange surface S through a metal supporting rod. The measurement was conducted in such a way that the temperature within the temperature boundary layer BL is measured by a digital scope, while the temperature of the moist air portion at the position where the thickness of the frost layer is measured is measured as a frost layer surface temperature. The heat transfer portion the side of which is thermally insulated by adhesive made of foamed urethane and silicone was disposed in the experimental small chamber made of Dan puller. It was confirmed that the frost layer surface temperature was below 0° C., so that the frost crystals P4 grew, in a case where the metal mesh is provided.

The embodiments of the present invention are described in detail above. A person skilled in the art may make various modifications and changes insofar as they are not out of the scope of the present invention.

For example, in this embodiment, although dehumidification was carried out within the temperature boundary layer BL by disposing the planar carrier C or the mesh carrier C within the temperature boundary layer BL determined in accordance with the temperature of the exchange surface S, the planar carrier C or the mesh does not need to be disposed, so long as dehumidification is secured within the temperature boundary layer BL.

For example, in this embodiment, although the mesh carrier C is disposed within the temperature boundary layer BL determined in accordance with the temperature of the exchange surface S, and then, is replaced, other physical object by which the formation of the frost is promoted may be disposed, so long as the formation of the frost or the dew on the heat exchange surface S can be prevented.

DESCRIPTION OF REFERENCE SIGNS

HX heat exchanger
C carrier
S surface of heat exchanger
O opening
N heat transfer promoter
BL temperature boundary layer
Tc coolant temperature
Tin temperature at inner surface of heat exchanger
Tout temperature at outer surface of heat exchanger
Tair temperature of moist air
Tm temperature of main air flow
W width of mesh
L width of opening
t thickness of heat exchanger
Y gap
P1 condensation liquid droplet
P3 super-cooled water droplet
P4 frost

The invention claimed is:

1. A method of maintaining a heat exchange surface which is in contact with moist air and is used for cooling, by suppressing the formation of dew and frost on the heat exchange surface, comprising:

arranging a carrier facing a heat exchange surface, within a temperature boundary layer which is determined in accordance with temperature and flow of moist air on the heat exchange surface, the carrier having a heat conduction ratio higher than that of the moist air in cases where the air temperature in the temperature boundary layer is either (i) below the dew-point and above 0° C., or (ii) below 0° C., and flowing the moist air along the heat exchange surface and the carrier, thereby removing moisture by condensing or sublimating water vapor in the moist air on a surface of the carrier, and replacing the carrier when dehumidifying performance of the carrier is deteriorated.

2. A method of cooling moist air through a heat exchange surface which is in contact with the moist air and is used for cooling, by suppressing the formation of dew and frost constituting a thermal resistant layer on a heat exchange surface, comprising:

arranging a carrier facing a heat exchange surface, within a temperature boundary layer which is determined in accordance with temperature and flow of moist air on the heat exchange surface, the carrier having a heat conduction ratio higher than that of the moist air in cases where the air temperature in the temperature boundary layer is either (i) below the dew-point and above 0° C., or (ii) below 0° C., and flowing the moist air along the heat exchange surface and the carrier, thereby removing moisture by condensing or sublimating water vapor in the moist air on a surface of the carrier.

3. The method of cooling moist air through a heat exchange surface according to claim 1, wherein the surface of the carrier on which the water vapor is condensed or sublimated faces away from the heat exchange surface, wherein the carrier is configured such that condensed liquid flows down along the surface of the carrier facing away from the heat exchange surface, and wherein the temperature of the moist air within the temperature boundary layer is above 0° C.

4. The method of cooling moist air through a heat exchange surface according to claim 1, wherein the surface of the carrier on which the water vapor is condensed or sublimated faces away from the heat exchange surface, wherein a temperature on the surface of the carrier facing away from the heat exchange surface is below the dew point of the moist air, wherein the temperature of the moist air within the temperature boundary layer is between 0° C. and −40° C., and wherein the surface of the carrier facing away from the heat exchange surface undergoes condensation, super cooling, and loss of super-cooling.

5. The method of cooling moist air through a heat exchange surface according to claim 2, wherein the surface of the carrier on which the water vapor is condensed or sublimated faces away from the heat exchange surface, wherein a temperature on the surface of the carrier facing away from the heat exchange surface is below the dew point of the moist air, and wherein the temperature of the moist air within the temperature boundary layer is below −40° C.

6. The method of cooling moist air through a heat exchange surface according to claim 2, wherein the surface of the carrier on which the water vapor is condensed or sublimated faces away from the heat exchange surface, wherein a temperature on the surface of the carrier facing away from the heat exchange surface is above the dew point of the moist air and below 0° C., and wherein the temperature of the moist air within the temperature boundary layer is below 0° C.

7. The method of maintaining a heat exchange surface according to claim 1, wherein the carrier is a planar structure with a regular or irregular cross section having non-opening portions and openings arranged in an alternate manner, each of the non-opening portions including a predetermined width, and wherein the carrier is disposed away from the heat exchange surface by a predetermined distance.

8. The method of cooling moist air through a heat exchange surface according to claim 2, wherein the carrier is a planar structure with a regular or irregular cross section and having openings of a predetermined width arranged in an alternate manner, and wherein the carrier is disposed away from the heat exchange surface by a predetermined distance.

9. The method of maintaining a heat exchange surface according to claim 7, wherein the carrier is a mesh-form including openings with predetermined widths and wires with predetermined widths and thicknesses.

10. The method of cooling moist air through a heat exchange surface according to claim 8, wherein the carrier is a mesh-form including openings with predetermined widths and wires with predetermined widths and thicknesses.

11. The method of maintaining a heat exchange surface according to claim 7, wherein the width of the carrier is between 100 μm and 2000 μm, the width of the openings is between 100 μm and 1000 μm, and the depth of the carrier from the surface of the carrier on a temperature boundary layer side thereof to a heat exchange surface side thereof is greater than 100 μm.

12. The method of cooling moist air through a heat exchange surface according to claim 8, wherein the width of the carrier is between 100 μm and 2000 μm, the width of the openings is between 100 μm and 1000 μm, and the depth of the carrier from the surface of the carrier on a temperature boundary layer side thereof to a heat exchange surface side thereof is greater than 100 μm.

13. The method of maintaining a heat exchange surface according to claim 1, wherein the carrier is a three-dimensional structure with voids, the carrier being constituted by fibers with predetermined lengths and a regular or irregular cross section being superimposed in a non-woven manner.

14. The method of cooling moist air through a heat exchange surface according to claim 2, wherein the carrier is a three-dimensional structure with voids, the carrier being constituted by fibers with predetermined lengths and a regular or irregular cross section being superimposed in a non-woven manner.

15. The method of maintaining a heat exchange surface according to claim 13, wherein the three-dimensional carriers are thickened in such a way that a portion of the carrier is disposed in a main air flow outside the temperature boundary layer, and wherein said method further includes a step of promoting heat transfer of the heat exchange surface by guiding the air flow inside openings of the carrier within the temperature boundary layer.

16. The method of cooling moist air through a heat exchange surface according to claim 14, wherein the three-dimensional carriers are thickened in such a way that a portion of the carrier is disposed in a main air flow outside the temperature boundary layer, and wherein said method further includes a step of promoting heat transfer of the heat exchange surface by guiding the air flow inside openings of the carrier within the temperature boundary layer.

17. The method of maintaining a heat exchange surface according to claim 7, further comprising a step of carrying out a water repellent treatment on the surface of the carrier to vary the surface condition of the carrier so as to improve the dehumidification performance by the sublimation, or the condensation of the water vapor on the surface of the carrier and so as not to block the openings under the liquid condition.

18. The method of cooling moist air through a heat exchange surface according to claim 8, further comprising a step of carrying out a water repellent treatment on the surface of the carrier to vary the surface condition of the carrier so as to improve the dehumidification performance by the sublimation, or the condensation of the water vapor on the surface of the carrier and so as not to block the openings under the liquid condition.

19. The method of maintaining a heat exchange surface according to claim 7, wherein the surface of the carrier is set to possess adsorption performance to vary the surface condition of the carrier so as to improve the dehumidification performance by the sublimation, or the condensation of the water vapor on the surface of the carrier.

20. The method of cooling moist air through a heat exchange surface according to claim 8, wherein the surface of the carrier is set to possess adsorption performance to vary the surface condition of the carrier so as to improve the dehumidification performance by the sublimation, or the condensation of the water vapor on the surface of the carrier.

21. The method of maintaining a heat exchange surface according to claim 7, wherein the carrier includes fibers which are made of a water absorptivity resin to enhance the water absorptivity, water retentivity, and capillary water absorptivity of the carrier to improve the dehumidification performance by the sublimation, or the condensation of the water vapor on the surface of the carrier.

22. The method of cooling moist air through a heat exchange surface according to claim 8, wherein the carrier includes fibers which are made of a water absorptivity resin to enhance the water absorptivity, water retentivity, and capillary water absorptivity of the carrier to improve the dehumidification performance by the sublimation, or the condensation of the water vapor on the surface of the carrier.

* * * * *